US010982497B1

(12) United States Patent
Herrick et al.

(10) Patent No.: US 10,982,497 B1
(45) Date of Patent: Apr. 20, 2021

(54) PIT LAUNCH DEVICE FOR HORIZONTAL DIRECTIONAL DRILLING

(71) Applicant: RODDIE, INC., Columbia Falls, MT (US)

(72) Inventors: Rod Herrick, Whitefish, MT (US); Jared W Shappell, Kalispell, MT (US)

(73) Assignee: RODDIE, INC., Columbia Falls, MT (US)

( * ) Notice: Subject to any disclaimer, the term of this patent is extended or adjusted under 35 U.S.C. 154(b) by 0 days.

(21) Appl. No.: 15/430,478

(22) Filed: Feb. 11, 2017

Related U.S. Application Data

(60) Provisional application No. 62/293,786, filed on Feb. 11, 2016.

(51) Int. Cl.
*E21B 19/08* (2006.01)
*E21B 7/04* (2006.01)
(Continued)

(52) U.S. Cl.
CPC ..... *E21B 19/083* (2013.01); *E21B 3/02* (2013.01); *E21B 7/02* (2013.01); *E21B 7/046* (2013.01); *E21B 17/16* (2013.01); *E21B 19/161* (2013.01)

(58) Field of Classification Search
CPC . F16L 1/024; F16L 1/032; F16L 1/036; F16L 1/038; F16L 1/028; F16L 1/09; F16L 1/02; E21B 19/083; B23Q 5/22
See application file for complete search history.

(56) References Cited

U.S. PATENT DOCUMENTS 3,554,298 A 1/1971 Klein
5,205,671 A 4/1993 Handford
(Continued)

FOREIGN PATENT DOCUMENTS

EP 980461 B1 8/2006
WO 2013/055389 A1 8/2013

OTHER PUBLICATIONS

Archive from Mar. 16, 2015: PBC Linear, Hevi-Rail® Combined Roller Bearings-High Load Linear Motion Product Webpage, available at https://web.archive.org/web/20150316205330/http://www.pbclinear.com/Hevi-Rail-Combined-Roller-Bearings--High-Load-Linear-Motion (Year: 2015).*
(Continued)

*Primary Examiner* — Robert E Fuller
*Assistant Examiner* — Theodore N Yao
(74) *Attorney, Agent, or Firm* — Robin Kelson Consulting, Inc.

(57) ABSTRACT

Disclosed are pit launched horizontal drilling devices suitable for drilling a substantially horizontal bore hole and laying pipe underground from a surface dug pit. The devices comprise a stationary frame and a carriage component competent to move forward and back along the frame and drill and retrieve an attached drill stem through an aperture in the frame, the device comprising mechanical linear actuator means for moving the carriage along said frame. The devices are compact, light-weight, easy to maneuver and suitable for utility contractor applications exhibiting on the order of about 800-15,000 lbs of push/pull force. Also disclosed herein are improved means and components for easily and quickly breaking drill stem joints, including integrated, positionable collar wrenches and breakout wrenches.

21 Claims, 14 Drawing Sheets

FIG. 2

(51) Int. Cl.

| | |
|---|---|
| ***E21B 3/02*** | (2006.01) |
| ***E21B 17/16*** | (2006.01) |
| ***E21B 19/16*** | (2006.01) |
| ***E21B 7/02*** | (2006.01) |
| ***E21B 19/083*** | (2006.01) |

(56) References Cited

U.S. PATENT DOCUMENTS

| | | | | |
|---|---|---|---|---|
| 6,109,831 | A | 8/2000 | Handford | |
| 6,206,345 | B1 * | 3/2001 | Lenahan | E21B 7/20 254/29 R |
| 6,736,219 | B1 * | 5/2004 | White | E21B 7/046 173/152 |
| 6,860,514 | B2 * | 3/2005 | Wentworth | E21B 17/04 285/333 |
| 7,318,491 | B2 | 1/2008 | Riel | |
| 2010/0193247 | A1 * | 8/2010 | Riddle | E21B 19/083 175/57 |
| 2012/0230771 | A1 * | 9/2012 | Farley | B23P 19/02 405/184 |
| 2013/0327543 | A1 * | 12/2013 | Reddy | E21B 19/14 166/381 |

OTHER PUBLICATIONS

Involute gear. Wikipedia entry. Available at https://en.wikipedia.org/wiki/Involute_gear (Year: 2020).*

Grundopit 40/60 Mini-Directional Drill—marketing brochure by TT Technologies, Inc.,2020 E New York Street, Aurora, IL 60502, dated 2005.

On-line Marketing Brochure: McLaughlin McL-10, by Mclaughlin Group, Inc. 2006 Perimeter Road, Greenville, SC 29605 http://www.mclaughlinunderground.com/wp-content/uploads/2013/08/McL-10-Lit.pdf.

Manual: McLaughlin McL-10 Manual, , by Mclaughlin Group, Inc. 2006 Perimeter Road, Greenville, SC 29605.

Pow-r Mole—marketing brochure by Pow-r Devices, Inc., 1400 Commerce Pkway, Lancaster NY 14086.

Article: "Small HDDs Take It the Final Feet", in Construection Equipment, dated Nov. 1, 2006; url: https://www.constructionequipment.com/small-hdds-take-it-final-feet.

Screenshot: DitchWItch PT1010 directional drill specifications—web page: https://www.mascus.com/specs/horizontal-drilling-systems-controllable_980141/ditch%20witch/pt-1010_989642.

Ditch Witch PT1010 images, from web.

Screenshots from Demonstration You Tube video "Pit Shot Drill" published Nov. 16, 2018. Url: https://www.youtube.com/watch?v=vUyiAM7NFY8.

MROSupply, Gear Rack Systems on-line description https://www.mrosupply.com/gears-gear-rack/gear-rack/ , retrieved Aug. 13, 2020.

Atalanta Drive Systems: Gear Racks: https://www.atlantadrives.com/racks.htm?msclkid=942118db8335128a20ca433a817e3dd9 retrieved Aug. 13, 2020.

Adantex: Gear Rack Catalog. p. 4 of : https://andantex.com/wp-content/uploads/2016/06/andantex-catalog-final-v4.pdf.

KHK Stock Gears:Online Gear Rack Catalog: https://khkgears2.net/catalog3/ retrieved Aug. 13, 2020.

* cited by examiner

PIT LAUNCH DEVICE FOR HORIZONTAL DIRECTIONAL DRILLING

CROSS REFERENCE TO RELATED APPLICATIONS

This application claims the benefit of Provisional Application No. 62/293,786, filed Feb. 11, 2016, the disclosure of which is hereby expressly incorporated in its entirety by reference herein.

FIELD OF USE

Embodiments of the present disclosure find applicability in the field of trenchless horizontal directional drilling. One useful field includes systems for placing gas, water, sewer, or other underground pipes, and/or for laying cable underground, including electrical, telephone and fiber optic cable.

BACKGROUND

Directional drilling machines and methods of use are well-known and well-characterized in the art. Also referred to in the art as boring, thrusting or horizontal drilling, the technology allows for the laying of pipe and cable underground (e.g., gas, water, sewer and drain pipes; ducts; power cables, telecommunication cables, including fiber optic cables, and the like) without needing to excavate or cut open the ground surface along the length of the pipe or cable to be installed. Typically, the process is executed by boring into the ground at an angle to a desired depth, then changing to a horizontal drilling direction. In "pit launched" applications, entry into the ground occurs from a first or "entry" access pit dug into the ground. For drilling distances on the order of 500 ft or less, and pipe or conduits of about 8-inches or less, the drill or boring apparatus can be placed inside the pit, and drilling occurs substantially horizontally from the start. The drill can gain its directional ability by means of an angled steering blade in the drill head behind which typically is a transmitter or locater beacon (e.g., "sonde" or GPS locator) that relays information to an above-ground operator so that drilling height and direction can be manipulated remotely to avoid obstacles and arrive at an intended location.

Directional boring machines are generally configured to drive a series of drill rods joined end-to-end to form a drill string. At the drilling destination, a second access pit or "exit" pit is provided. Alternatively, the destination can be inside or under a building, typically a basement or underground crawl space. When the drill head penetrates the second access/destination pit wall, the drill head is removed in the pit, and a pipe or conduit cable is attached to the drill string, optionally behind a rotating reamer head that serves to enlarge the bore as the pipe or cable is being pulled back through the bore by the retracting drill string. Once the pipe or cable is pulled through the bore hole to the entry access pit, it is disconnected from the drill string, and connected as desired to the service source and service receiver. Patent publications U.S. Pat. Nos. 6,109,831; 5,205,671; 3,554,298; EP 0 904 461; and WO 2013/055389 are representative of the art.

Small model trenchless directional drills (having pullback ratings of 20,0000 pounds or less), currently make up over 60% of the horizontal directional drilling market. Pit launch models, characterized by a hydraulic drive motor that sits in the entry pit to be operated from within the pit, are particularly attractive for operations requiring in the range of about 5,000-20,000 pounds of pullback, drilling lengths in the range of less than about 1,000 ft, and small diameter pipe (typically about 4-inches or less). There is an on-going desire and need for developing small model pit-launched trenchless directional drills that are easy to operate, rugged, and provide the desired pull back capacity and speed without being cumbersome to transport and install.

Current pit launch models typically comprise a chassis or stationary frame that provides means for bracing the device against the front and back end of the entry pit, and a moveable component, typically comprising a hydraulic drive mechanism, that can move or slide the length of the chassis or stationary frame, and is competent to drive a drill stem into the ground from the pit to create a bore hole, and then pull the drill stem back into the pit, typically together with an attached pipe. Generally, the moveable hydraulic drive mechanism also has hydraulic controls for operator manipulation, generally from within the pit. Depending on the size of the pit and the pounds of pullback required, the pit launch device itself may sit within a larger metal box which itself may define the entry pit.

The moveable components of pit launch models in the art generally rely on a glide system of some sort. For example, certain models are designed with the drive motor sliding along a central longitudinal beam that also provides support and stabilization during the drilling operation. Other glide systems have the drive motor suspended between the parallel walls of the chassis frame, and slide along on top of the frame.

There remains an on-going need for compact pit-launched horizontal directional drilling machines that are lightweight, compact, easy to install and set-up, require minimal maintenance, particularly in the field, and which provide maximum life. Current pit launch models can weigh in excess of 1,000 pounds, have dimensions in the range of 5 or 6 ft in length, 4 ft in width, and 3-4 ft in height. This makes the current models cumbersome to transport and maneuver into place, and requires pits to be dug that are of a sufficient size to accommodate them. A smaller, more compact model would mean less digging, less impact to the entry pit site, and less operation time. Moreover, many hydraulic drive mechanisms in the art rely on plastic glide systems or bushings that wear excessively. Others rely on metal bushings that cause excessive friction, reducing the overall effective thrust and pullback power of the device, and/or cause excessive wear on the slide mechanism. Where the slide or rail mechanism is fabricated on top of or over the outside opposing longitudinal side panels of the stationary frame, this adds to the overall weight and size of the device.

There also remains an on-going need for improved means for easily and quickly cracking drill stem joints during operation, both when building a drill string to create a bore hole, and when retrieving a drill string once the bore hole is formed. Accordingly, improvements in stem adapter wrench collars and breakout wrenches and their methods of use are disclosed herein.

SUMMARY

This summary is provided to introduce a selection of concepts in a simplified form that are further described below in the Detailed Description. This summary is not intended to identify key features of the claimed subject matter on its own, nor is it intended to be used alone as an aid in determining the scope of the claimed subject matter.

In accordance with one embodiment of the disclosure provided herein is an improved pit launch horizontal directional drilling device. The devices disclosed herein have greater thrust and pullback per unit of power applied, less friction, and less wear or maintenance difficulties, compared with similar pit launch devices in the art.

In one embodiment, the device comprises a chassis or stationary frame component and a carriage component coupled to the chassis and competent to move forward and back along the longitudinal axis or length of the chassis component. The chassis component comprises a back plate, opposing, parallel side panels extending forward from the back plate and ending at a front plate, the front plate comprising a drill bore aperture. The chassis or stationary frame also typically can include a floor plate. Preferably the floor plate includes one or more coverable openings or washout plates for draining any liquid that may accumulate on the chassis floor.

The carriage component, also referred to herein as a drive unit, comprises a hydraulic rotary drive unit for drilling and retrieving an attached drill stem or drill string through the drill bore aperture, a hydraulic directional movement means for moving the carriage component along the chassis between two limiting positions, and hydraulic valving means for directing rotation of an attached drill stem and movement of the carriage component along the chassis.

In another embodiment, the device comprises a linear actuator means for moving the carriage along the frame. In another embodiment, the linear actuator means is a mechanical linear actuator that is hydraulically driven. In still another embodiment, the linear actuator means comprises a toothed rack and gear system. In the art such systems can be referred to as a rack and pinion system or a rail rack system. In still another embodiment, the rack comprises a toothed rack or bar or rod or rail positioned on the inside surfaces of each of the opposing, parallel chassis side panels. In another embodiment, the pinion gear extends or protrudes from lateral opposing sides of the carriage component and is dimensioned to engage the toothed rod or bar positioned on each opposing and corresponding chassis side panel. In one preferred embodiment, a useful gear ratio is 1:6. In another embodiment, other gear ratios can be used to advantage. For example, where more thrusting power may be sought, useful gear ratios can be 1:8 or 1:10 or lower. Those skilled in the art will appreciate that a lower gear ratio can provide more power, and a slower speed.

In still another embodiment, the device has means for reducing friction as the carriage component moves along the chassis. In still another embodiment, the device has means for reducing horizontal vibration as the carriage component moves along the chassis, particularly when the carriage component or drive unit also is drilling a drill stem as it moves along the chassis. In one preferred embodiment the friction reducing means comprises a linear bearing system. In another embodiment, horizontal vibration management means is provided by the linear bearing system. In still another embodiment the linear bearing system comprises a high load capacity bearing guide system. In still another embodiment, the high capacity load bearing system comprises a dual ball bearing and engagement system. In still another embodiment the dual ball bearings comprise an axial load bearing and a radial load bearing. In still another embodiment the dual ball bearings project or extend out from lateral, opposing sides of the carriage component, and the engagement system is located on the inside surface of the opposing, parallel chassis side panels and is dimensioned to receive the bearings. In one currently preferred embodiment, the engagement system comprises a rail. In another embodiment, the engagement system can be a U-channel or I-channel or clamp flange or flange plate, as appropriate.

In another embodiment, a method of drilling a substantially horizontal bore hole from a surface dug pit is provided, using the devices and components described herein.

In still another embodiment devices, components and means are disclosed herein for quickly and easily cracking open drill stem joints during the process of building and retrieving drill stems or drill strings underground. In still another embodiment, an improved drill stem collar wrench, mechanism, and method of use are provided. In one embodiment the collar wrench disclosed herein is integral to the carriage component and can be moved on and off a drill stem adapter easily. In another embodiment a breakout wrench that is integral to the chassis component is provided, along with mechanisms and methods of use.

In one embodiment, provided herein is an integrated, fixed mechanism for movably positioning a wrench collar (or "collar wrench") over a drill stem joint, the collar having a central channel dimensioned to slide over a rod or tube and having an inner surface dimensioned to inhibit unthreading of a drill stem joint when positioned on the joint. In one preferred embodiment the mechanism comprises attachment means for fixing the collar mechanism to a location on or near the desired drill stem joint; pivotable gripping means for gripping or holding the outer surface of the collar, and a movable handle connected to the pivotable gripping means and competent to initiate pivoting of the gripping means, such that the collar is moved on and off the stem joint by the pivot action.

In one preferred embodiment the mechanism and wrench collar device are fixed to the front end of the hydraulic drive unit. In another embodiment, the gripping means comprises a jaw or C-shaped component with protrusions or pins at its ends, the pins dimensioned to fit into apertures in the collar's outer surface. In another embodiment, the apertures comprise a groove that circumscribes the collar's outer surface. In still another embodiment, the pivotable means comprise pin and eye combinations connecting the collar jaw to the handle. In still another embodiment, a pin and eye combination also links the collar jaw to the fixed attachment means, such that the fixed attachment means acts as a brace support for the mechanism's pivoting action. In still another embodiment, the moveable handle is connected to the pivotable jaw by means of a positioning bar, such that handle manipulation forward and back moves the positioning bar forward and back, causing pivoting of the attached jaw.

In another embodiment, devices, components, mechanisms, systems and methods of use for a drill stem joint breakout system are described. In one embodiment, a drill stem joint breakout mechanism comprises a fixed, positionable wrench element, also referred to herein as a breakout wrench, attached to a surface near a drill stem joint member. In another embodiment, the breakout wrench is attached to a surface so as to be positioned lateral to the joint to be opened. In still another embodiment the surface attachment means comprises a lateral or horizontal slide mechanism, such as a rail mechanism, a tongue and groove mechanism, or an interlocked step or ridge or lip mechanism. In still another embodiment, means for moveably positioning the breakout wrench on and off a stem joint occurs by means of a handle associated with the wrench and competent to move the wrench along the slide mechanism.

The pit launch devices disclosed herein can achieve pull back in the range of at least about 8,000-15,000 pounds, rotational speeds in the range of at least about 100-150 rpm's, accommodate at least about 1100 ft-lbs. torque. They can build and retrieve drill strings extending out at least about in the range of 100-500 ft, and weight less than about 700 lbs. In another embodiment the pit launch devices disclosed herein can weigh less than about 600 lbs. In still another embodiment the pit launch devices disclosed herein can weigh less than about 550 lbs. In still another embodiment, useful pit launch devices disclosed herein can be fabricated to weigh less than about 350 lbs., or even less than about 300 lbs.

In another embodiment, useful pit launch models disclosed herein can be dimensionally compact when compared with similar pit launch deices in the art. Useful devices can have a chassis that is in the range of about 2 ft wide, and side panels with a height in the range of about 6-12 inches. Chassis lengths can be in the range of about 4 ft when using 2 and 3 ft drill pipes, and shorter for shorter drill stems. As described herein below, using an extendable tailstock for the chassis' back plate keeps the chassis dimensions compact, and still adaptable to accommodate larger drill pipes, such as 3-ft pipes. In still another embodiment, devices wherein the carriage component is engaged with the chassis component, the overall height of the device can be in the range of about 20-26 inches.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Embodiments of the present disclosure provide devices, components, mechanisms and methods of use for directional drilling in confined spaces, and more particularly for horizontal directional drilling using a lightweight, portable, pit launch device having enhanced function and durability. Also disclosed are devices, components, mechanisms and methods of use for easily and quickly cracking drill stem joints during drilling and/or cable pulling operations.

The pit launch hydraulic horizontal drilling devices disclosed herein are compact, lightweight and portable. The devices can be dimensioned to accommodate 18-inch, 2-ft or 3-ft drill stem pipes, with thrust and pullback power in the range of at least about 8,000-15,000 lbs, at least about 1100 ft-lbs. torque, and capable of delivering drill stems or strings distances underground in the range of at least about 100-500 ft. Moreover, the devices can be fabricated to weigh less than about 600 lbs, and even less than about 550 lbs. or 500 lbs, as desired. Particularly where shorter drill pipes are being used, the devices can weigh on the order of about 300-400 lbs.

Figure 1:
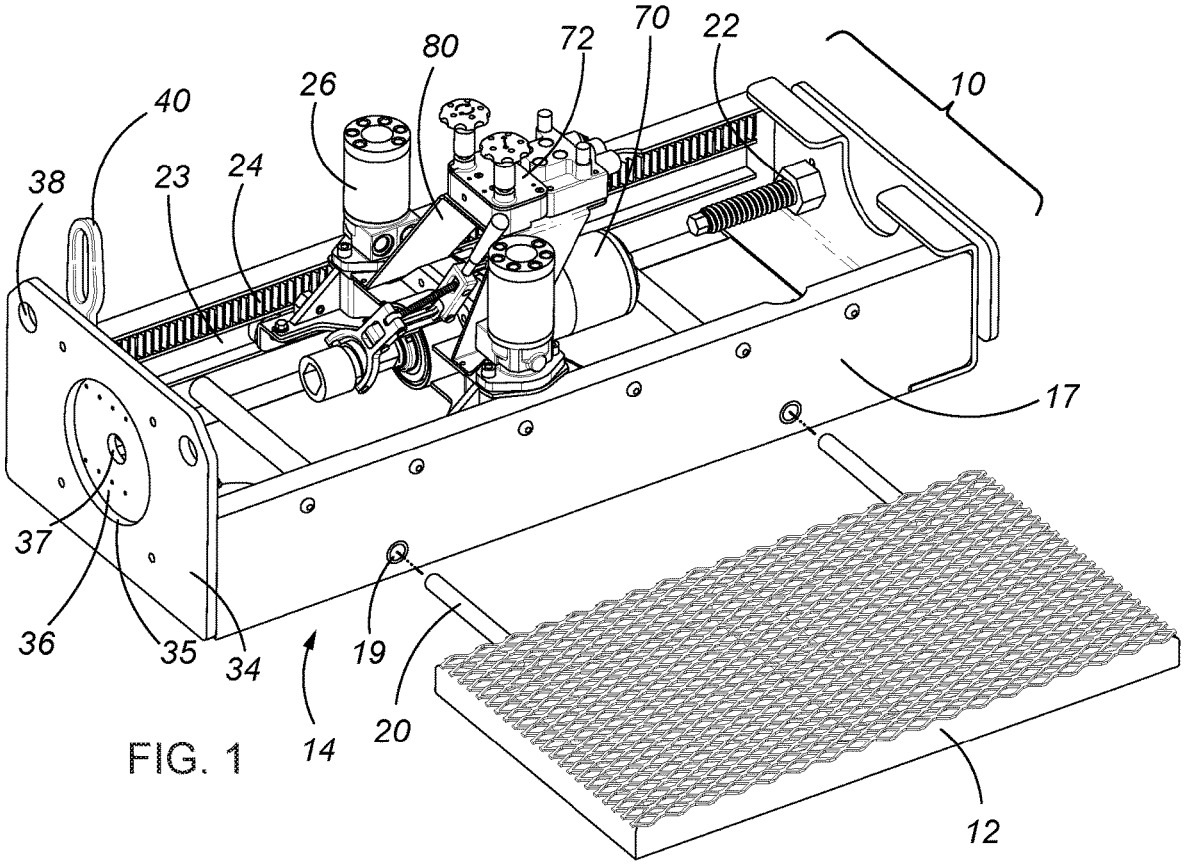
FIG. 1 illustrates one embodiment of a pit launch directional drilling device of the present disclosure.
Figure 2:
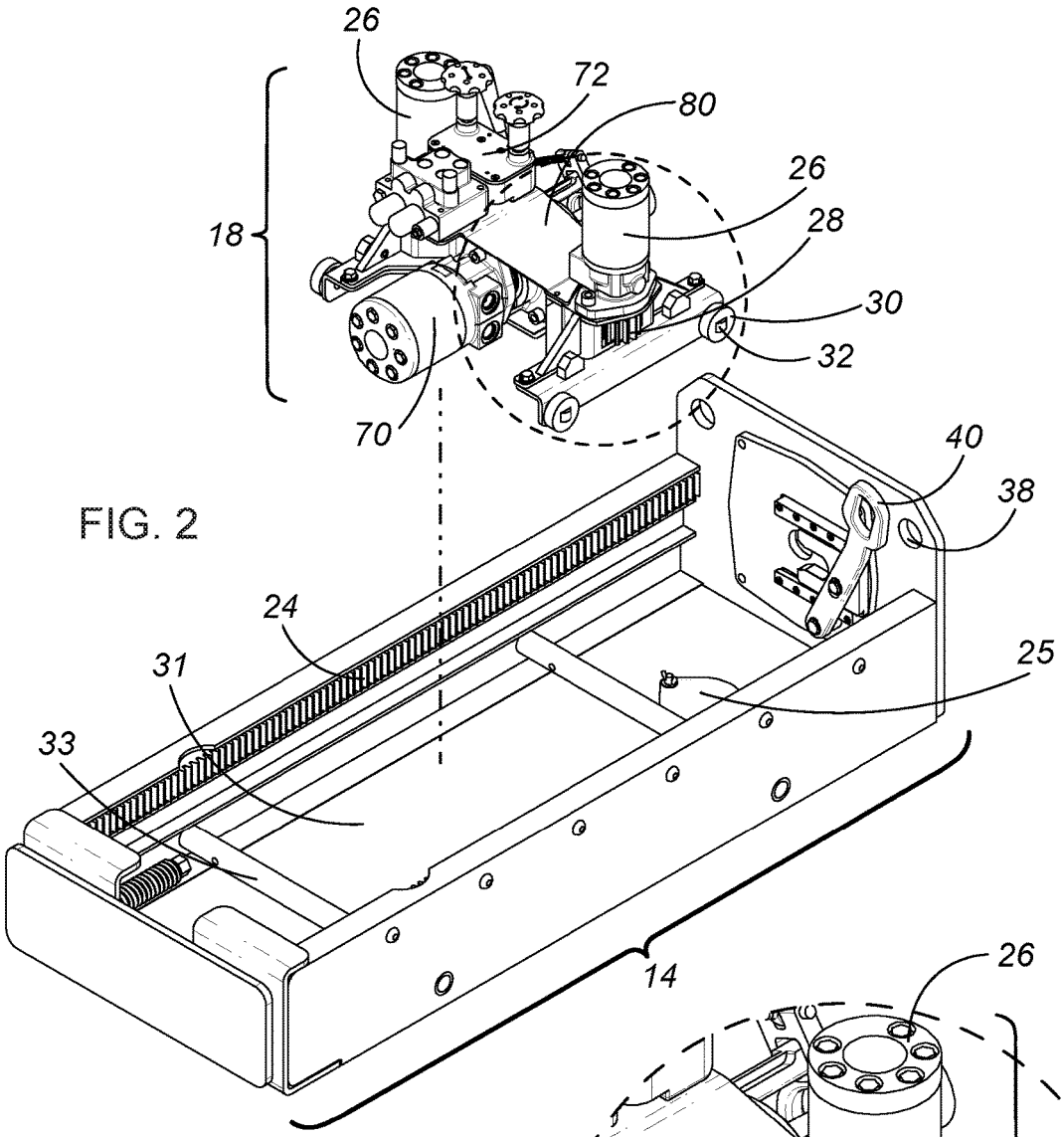
FIG. 2 is an exploded view showing the device of FIG. 1 with the chassis and carriage components separated.
Figure 3:
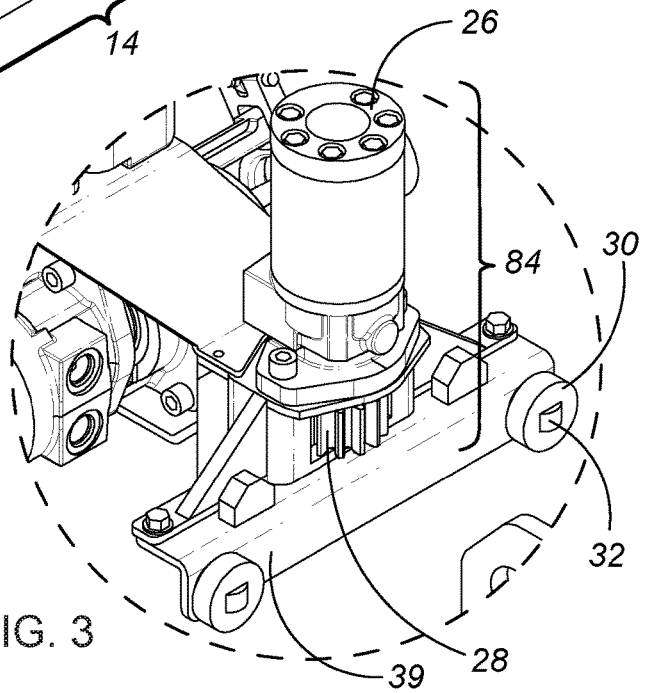
FIG. 3 illustrates one embodiment of a hydraulic drive gear mechanism and high load capacity bearing guide system according to one embodiment of the present disclosure.
Figure 16:
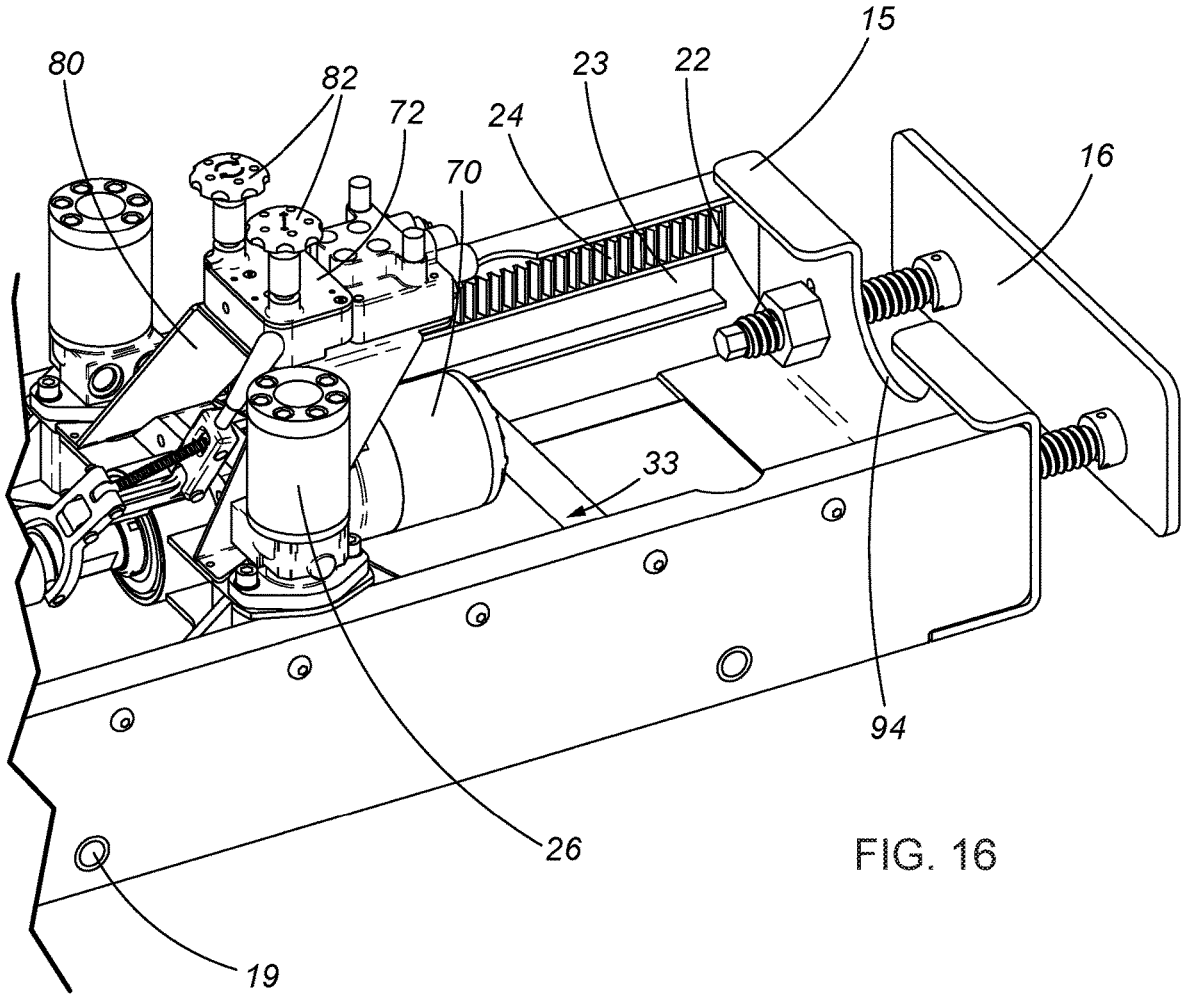
FIG. 16 illustrates an embodiment of a pit launch device according to the present disclosure, with the moveable tailstock extended.

As illustrated in FIGS. 1, 2, and 16, the device 10 can comprise a chassis component 14 and a hydraulic directional drive component 18. The chassis component 14 can comprise a bottom 31, a front plate 34 and back plate 15. Back plate 15 also can include a moveable tailstock 16, which can be attached to back plate 15 by any adjustable means, including, for example, a screw and bolt mechanism 22. Moveable tailstock 16 can provide a device with enhanced flexibility for drilling in different size pits and drilling different length drill stems (e.g., 18-in, 2-ft and 3-ft). Back plate 15 also can be contoured, to accommodate the drive component extension. In one embodiment, illustrated in FIG. 16, contour 94 can have a shape that accommodates a horizontally positioned hydraulic motor 70.

Front plate 34 also can include an aperture 35 through which a drill string can be bored into the earth in a substantially horizontal manner. Aperture 35 also can include a wiper plate 36 which itself can have an aperture 37. Wiper plate 36 can assist in wiping liquid and/or debris off a drill string, particularly when the drill string is being retrieved during a cable or conduit pulling operation. In addition, floor 31 of chassis component 14 can also include an opening and washout plate or cover 25 for draining any fluid that can accumulate in the chassis during operation.

Chassis component 14 also can comprise a standing plate 12 that can be attached to one or both longitudinal side panels 17 of chassis component 20. Standing plate 12 can provide a surface on which the device operator can stand or otherwise position him or herself during operation, and can include a slip-resistant, durable surface, preferably permeable to liquid. Metal grill work surfaces can be used to advantage. Placing the standing plate for an operator outside the device is another means for enhancing the compact, lightweight character of the device of the present disclosure.

Standing plate 12 can be attached to chassis component 14 by any standard means. In one embodiment, plate 12 can comprise one or more pins 20 that fit into apertures 19 in chassis 14. In another embodiment, pins 20 fit into hollow tubings 33 that span chassis component 14 and are accessible from both side panels via apertures 19, making device 10 universal or symmetrical with respect to standing plate 12. This allows the operator to choose and change on which side to locate the standing plate based on the conditions of the site location as desired. In one preferred embodiment, tubings 33 are fabricated and attached to chassis side panels 17 using metals of appropriate strength and load bearing capacity so as to provide both a means for receiving pins 20 and provide bracing support for device 10 during operation.

Chassis component side panels 17 can each include parallel, opposing gear racks, also known as toothed rods or bars 24 for engaging a hydraulic gear drive mechanism on drive component 18. Sides 17 also can include guide systems 23 for receiving and holding high load capacity linear bearings 30 on drive component 18. In the figures guide system 23 is depicted as a rail. It will be understood that the guide systems, also known in the art as linear bearing system rails, can include rails, !-channels and U-channels. Other rails used to advantage with high load capacity linear bearings can include clamp flanges or clamp plates where appropriate.

As illustrated in FIGS. 2, 3, 15A, 15B and 16, drive component 18 preferably comprises a hydraulically driven mechanical gearing mechanism for moving drive component 18 forward on chassis 14 and boring drill stems into the earth through aperture 35. The gearing mechanism can be described in the art as a rack and pinion system or a rack rail system. The figures also illustrate one means for accommodating directional motors for (1) moving the drive component along the chassis and (2) rotating a drill pipe onto or off an existing drill string. In the figures drive component 18 comprises parallel, opposing hydraulic motors 26 that rotate pinion gears 28 engaged with toothed racks 24 on chassis sides 17. Together toothed racks 24 and gears 28 can act as a rack rail for moving drive unit 18 along chassis 14. Directional movement of drive component 18 forward and back along the chassis longitudinal axis can be managed by a hydraulically driven mechanism, such as the geared directional control 72 shown in FIGS. 1, 15A, 15B and 17B. Other control means are well known and described in the art, including, without limitation, joystick mechanisms.

Figure 4:
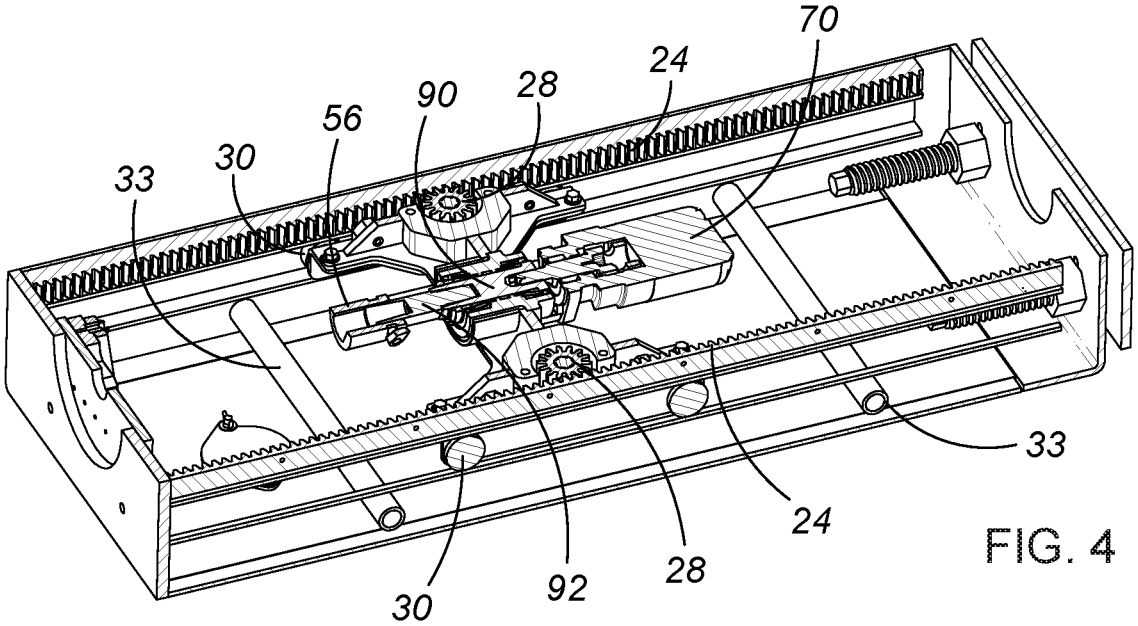
FIG. 4 is a cross-section of a chassis component according to one embodiment of the present disclosure, illustrating a toothed gear rack and bearing guide system.
Figure 5:
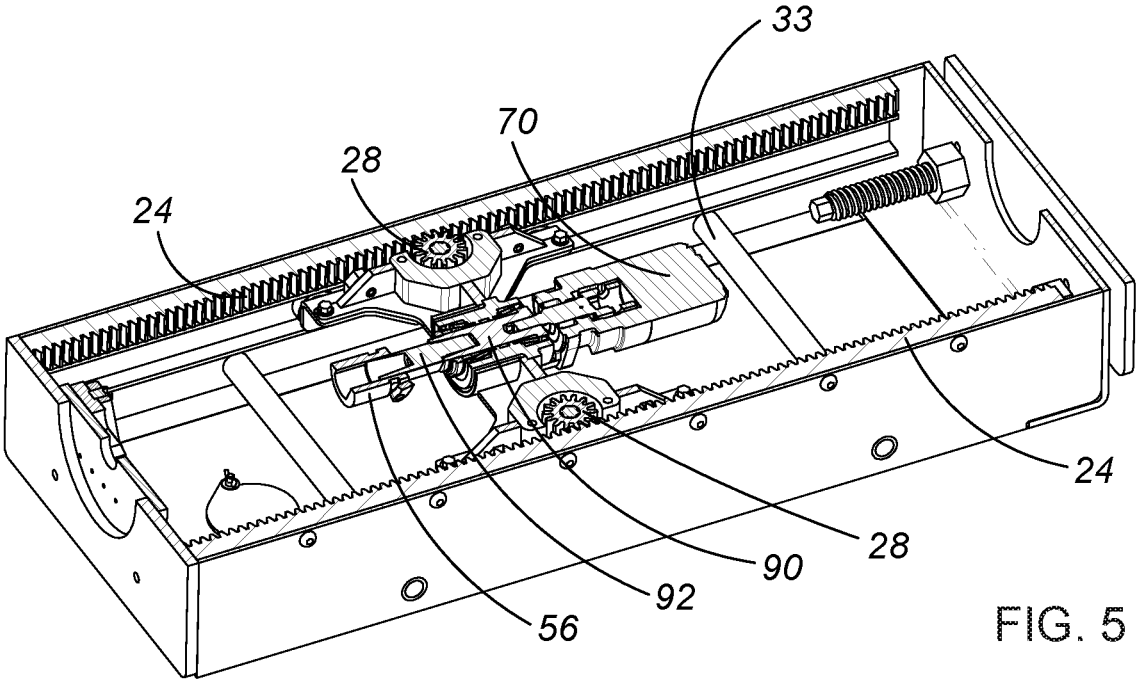
FIG. 5 is another cross-section of a chassis component according to one embodiment of the present disclosure, illustrating a toothed gear rack and bearing guide system.
Figure 6A:
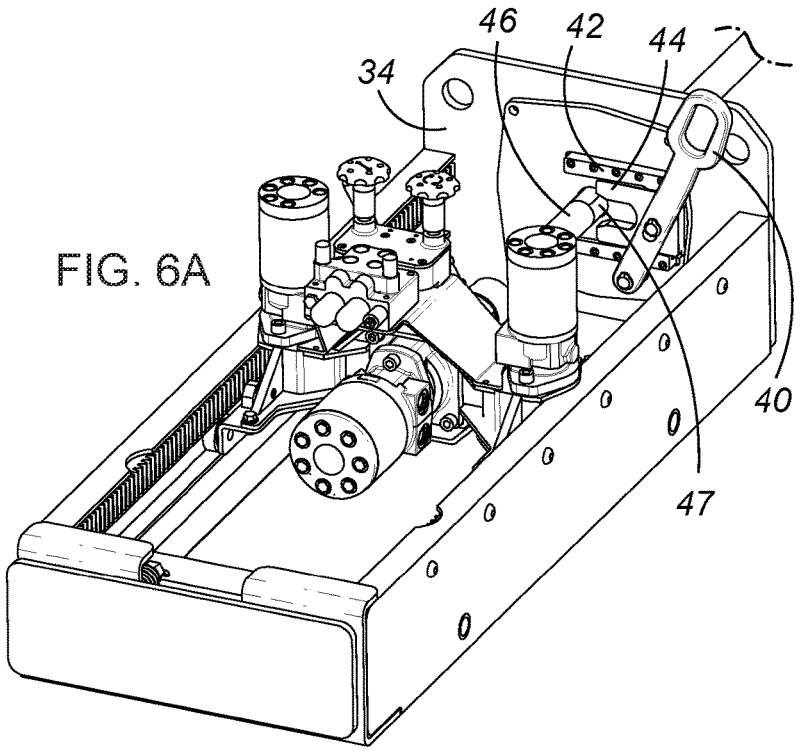
FIGS. 6A and 6B illustrate one embodiment of an integrated breakout wrench of the present disclosure in a resting (6A) and engaged (6B) position.
Figure 6B:
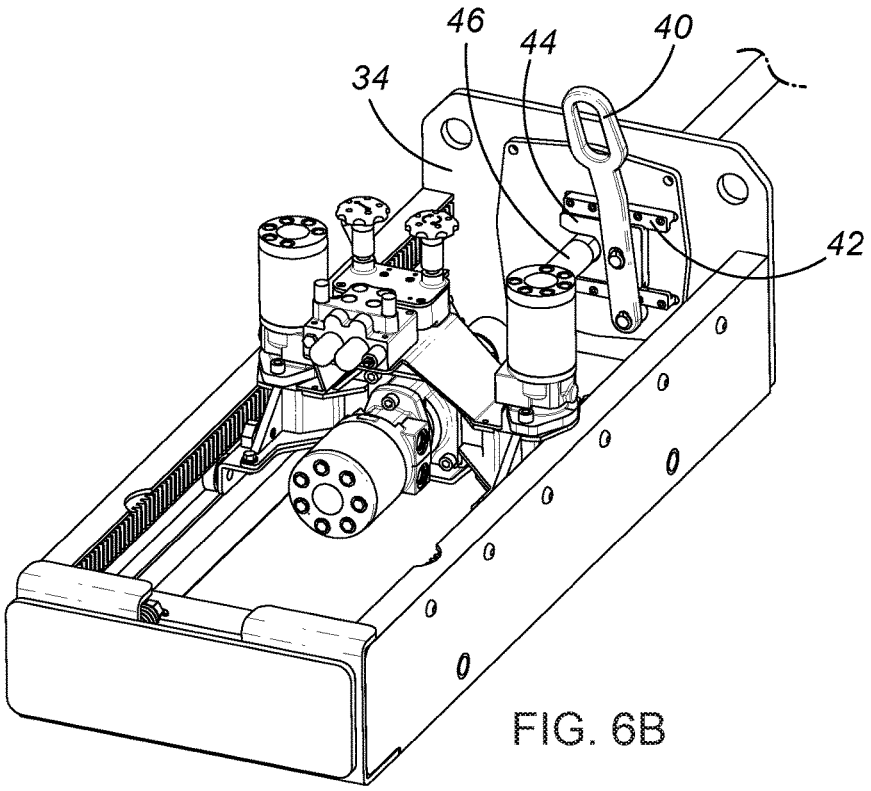

Drive component 18 also preferably includes a hydraulic motor 70 for driving the rotational motion of a drill stem to be added to or removed from a drill string. As illustrated in FIGS. 1, 4 and 5, hydraulic motor 70 can translate rotational motion to an attached drill stem via a water spindle 90 and a stem adapter 92. As for the directional drive mechanism, directional control of drill stem rotation can be managed by a hydraulically driven gearing mechanism 72 or other means well known in the art, including, without limitation, a joystick mechanism. FIG. 16 illustrates one embodiment of directional control means 82, and others are envisioned, and available in the art.

Figure 17A:
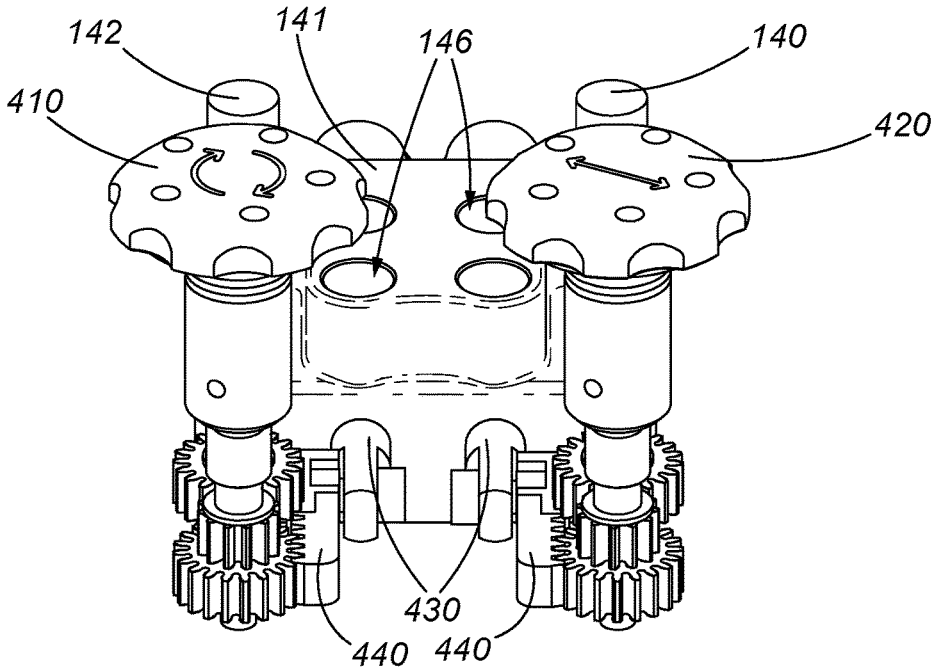
FIGS. 17A and 17B illustrate a hydraulic gearing mechanism in one embodiment of the device of the present disclosure.
Figure 17B:
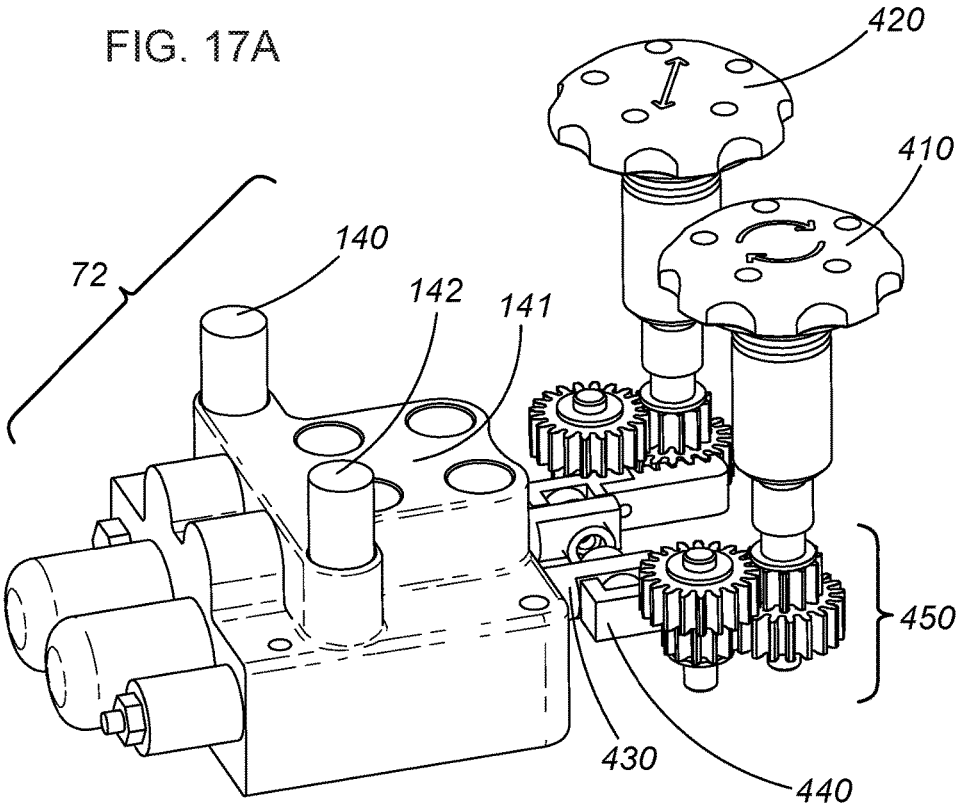
Figure 18:
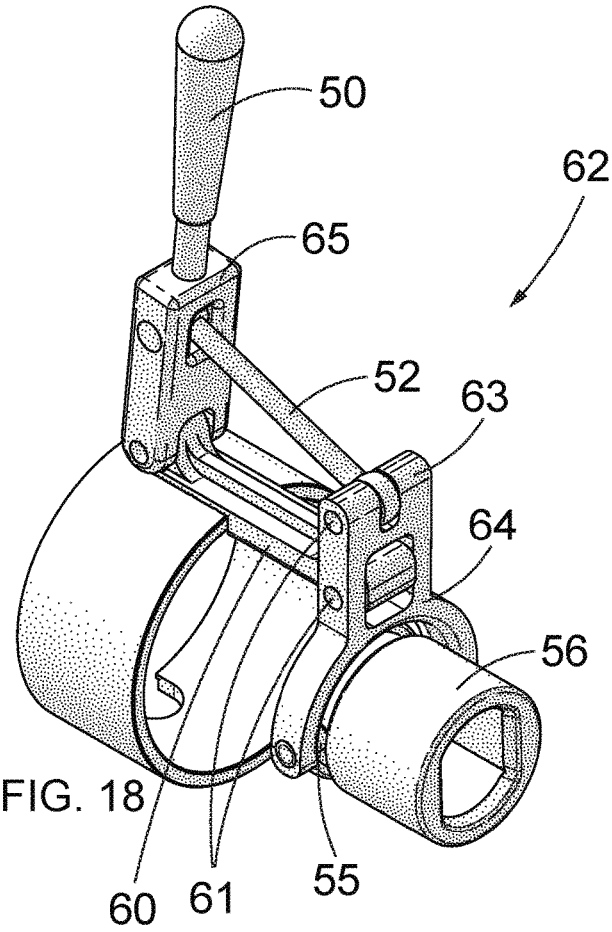
FIG. 18 illustrates in close-up an embodiment of an integrated wrench collar according to the present disclosure, in the resting position.
Figure 19:
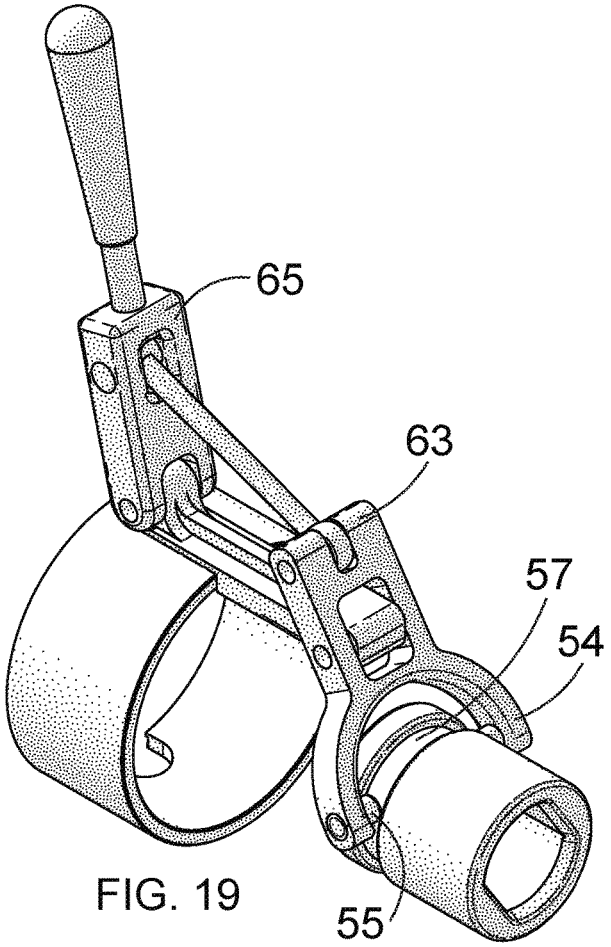
FIG. 19 illustrates in close-up an embodiment of an integrated wrench collar according to the present disclosure, in the engaged position.

One embodiment of a gearing mechanism 72 is illustrated in FIGS. 17A and 17B. Those skilled in the art will appreciate that valving units are well-characterized and known in the art, and useful systems can be fabricated without undue experimentation. The valving unit in the figures comprises a standard hydraulic quick disconnect 4-position valving unit such as are well characterized in the art. The unit comprises a male hydraulic in port 140, a female hydraulic out port 142, a valving compartment 141, multiple hydraulic valve lines (e.g., 146) transferring fluid as directed to drive activity, and means for directing fluid to the various hydraulic valve lines. In FIGS. 17A and 17B, a valving unit mechanism is depicted comprising two independent gear-driven controls. Rotary drive control 410 independently directs fluid to the rotary stem pipe drive. Directional drive control 420 directs fluid to the carriage drive (illustrated in FIG. 3). The independent gear-driven controls disclosed can have the advantage of providing greater control over the speed of the drives if this is desired. For example, it often is advantageous to be able to manually modulate carriage drive speeds when retrieving drills stems and pulling cable or pipe back through a bore hole.

As will be appreciated by those having ordinary skill in the art, a gear-based control system provides a means for transmitting rotational motion from an input gear to an output gear, varying the speed ratio by varying the gear ratio. Any useful gear ratio can be fabricated without undue experimentation. One commonly useful gear ratio is in the range of about 2:1, and the mechanism in FIGS. 17A and 17B depict one common embodiment for generating a 2:1 ratio. In the figure, the output gear associated with input gear 410 or 420 transmits the rotational motion to a gear rack 440, which manages movement of a spool 430 in and out of hydraulic valving unit compartment 41, thereby managing the volume of hydraulic fluid (and therefore power) to the associated motor. Useful hydraulic motors having application in directional drilling devices disclosed herein can be high-torque, low-speed motors, with operational rpm's in the range of at least about 200-600 rpm's, and hydraulic fluid gpm's in the range of at least about 10-25 gpm's. One useful hydraulic motor type that can be used to advantage is a gerotor or positive displacement pump.

Device 10 dimensions can be optimized by optimizing arrangement of hydraulic components of drive mechanism 18. In the figures, (see, e.g., FIGS. 1, 15A, 15B and 16) directional control mechanism 72 is stacked on a brace 80 over a centrally positioned water spindle (not shown), and hydraulic motor 70 for the directional control mechanism is positioned laterally along the chassis longitudinal axis, posterior to the water spindle and pipe stem adapter. Similarly, opposing pinion gears 28 are driven by opposing hydraulic motors 26, positioned vertically over their respective gearing mechanisms.

In the embodiment illustrated, gear drive mechanisms 84 (see, e.g., FIGS. 1 and 3), sit above high-load capacity linear bearings 30 that fit in linear bearing guide systems 23 on chassis side panels 17. Preferably, bearings 30 can include needle bearings 32 and provide high axial and radial load capacity during operation. The combination of an internally located, lateral, opposing toothed rack and pinion gearing mechanism for linear drive unit movement along a chassis and drill stem drilling, together with a high load dual ball bearing system that provides both axial and radial load capacity and force translation, provides a powerful, durable, compact drive mechanism and drilling device with reduced friction and/or horizontal vibration during operation, and fewer maintenance issues than similar devices currently available.

Linear dual ball bearing systems are well understood and available in the art; useful sources include, without limitation, Pacific Bearing Company and their Hevi-Rail linear guide or glide systems. Choice of bearing and guide system will depend on the dimensions chosen for the device being fabricated, the desired thrust and pullback of the device, and the drilling distances anticipated. Those having ordinary skill in the art will appreciate that useful engagement systems for receiving the high load capacity bearings could include U-channel glides, I-channel glides, and flared plates. In one embodiment, linear bearings useful in the device have a fixed axial bearing. In another embodiment, useful linear bearings having a radial load w/alt. rail have a dynamic load in the range of least about 24 KN, and a static load in the range of at least about 33 KN. In another embodiment, useful linear bearings having an axial load w/alt. rail, have a dynamic load in the range of at least about 10 KN and a static load of at least about 14 KN. Those skilled in the art will appreciate that the high load capacity linear bearing and guide system manages torque generated during the drilling or pulling operation, and reduces friction. In addition, the toothed rack and pinion gearing system limits unwanted slide back during operation, which can be a common operational issue at higher pullback and thrust values, particularly at values greater than about 5,000 foot-lbs.

As described above for the gear-based control system, choice of the toothed rack and pinion gearing also can be varied, depending on the power needs of the operation. One useful gear ratio is 1/6 or 1:6. Others can be used to advantage and can be determined by those having ordinary skill in the art, provided with the instant disclosure. For example, where greater thrust or pull back capability is desired, lower ratios may be selected including, without limitation, 1:8 or 1:10.

Chassis dimensions can be built as desired. Dimensions need to accommodate drill stem, motors and gearing mechanisms. Stacking components allows for narrow, shallow boxes. The device can be placed in, braced against, and/or bolted to the front and back of an entry pit (e.g., using bolt holes 38) as is. Alternatively, it can be placed inside a larger box that provides the pit launch parameters. Choice of materials for chassis and drive unit fabrication are within in the skill of the art to determine, with attention given to selecting materials of suitable strength, load capacity and durability, among other standard criteria.

Referring now to FIGS. 15A, 15B and 18-23, various embodiments of an integrated wrench collar useful in the devices of the present disclosure are illustrated. In horizontal drilling devices, wrench collars can be used to advantage to preferentially and selectively inhibit rotation of an attached pipe stem by collaring and holding the stem joint created between a stem pipe and a drill stem adapter. It will be appreciated by those having ordinary skill in the art that the fixable, positionable collar disclosed herein has application beyond the present devices and finds utility in any application where a readily accessible, easily engaged and removable anti-torquing means is desired. Particularly useful are any jointing applications comprising rod or tubular components and joints, where anti-rotational or anti-torquing action is desired and where regular repeated access to the joint is preferred. Useful joints include those in any drilling application and could include, without limitation, angled joints.

Referencing FIGS. 15A, 15B, 18 and 19, embodiments of a wrench collar pivot positioning mechanism or system 62 are illustrated. Drill stem adapter 92 can have opposing parallel flats 91 machined along the outside barrel length of adapter 92 anterior to a threaded pin end. Flat 91 can have a dimensional width substantially matching flats on a drill stem section 58 to be added to the drill string. Collar 56 can comprise a hollow sleeve or channel competent to slide over a drill stem section 58 or an adapter 92. In this embodiment, the inner sleeve or channel of collar 56 can have a diameter sufficient to contact, receive and slide over adapter stem 92 and flat 91 of attached drill stem section 58. Forward movement of collar 56 along pipe stem 58 can be prevented by a lip at the anterior end of flat 91.

Collar 56 further can comprise an inner circumference contour dimensioned to mirror the outer circumference contour of adapter 92 and the stem flat component of a stem pipe section 58. That is, the inner contour of collar 56 can comprise opposing parallel flats 93 machined along its internal longitudinal axis, the flats 93 having substantially the same dimensional width as stem adapter flats and drill stem flats.

Collar 56 also can comprise an integrated positioning mechanism for moving the collar on and off a stem adapter/drill stem joint. When positioned over the joint, collar 56 and the collar's inner circumference contours hold the joint members stable relative to one another, preventing undesired unthreading when pipe sections are being cracked open using a breakout wrench during pipe string retrieval. While collar 56 also can be used to prevent over-torquing or over-rotation, for example while attaching pipe section 58 to a building drill string or during drilling of the string, drill stem joints having utility in the present disclosure typically use tapered threads designed and fabricated to prevent over-torquing when engaged, and so use of collar 56 may not required during forward drilling operation.

When not in use, it is preferable if collar 56 can be located near the joint, out of position. Wrench collar integrated positioning means 62 provides an example of a useful mechanism for achieving this outcome. The mechanism comprises a claw or jaw or C-shaped component 54 that grips collar 56 and moves it in and out of position. In one embodiment the gripping mechanism comprises pins or protrusions 55 extending out from the ends of jaw 54 and which fit in a groove or track 57 scribed into the outer circumference of collar 56. Jaw 54 is maneuvered by means of attached positioning arm 63 that extends up from jaw 54. Positioning arm 63 can be manipulated by device handle 50 through its positioning bar connector 65. In one preferred embodiment, handle 50 and its positioning bar connector 65 engage with arm 63 by means of positioning bar 52, which can be adjustable, for example by threading means about bar 52's surface that can be screwed into connector 65. In another preferred embodiment, collar wrench positioning mechanism 62 further can be supported by a brace 60 that projects out from or is cantilevered from the anterior end of the directional drive mechanism. Preferably, brace 60 has a pivotable connection to arm 63. In another preferred embodiment, arm 63 has pivoting attachment means for connecting arm 63 to bar 52, and to brace 60. In one embodiment, a useful pivoting attachment means can include an eye and pin combination 61. Of course, other pivot means are within the skill of the art to fabricate and utilize.

Figure 20:
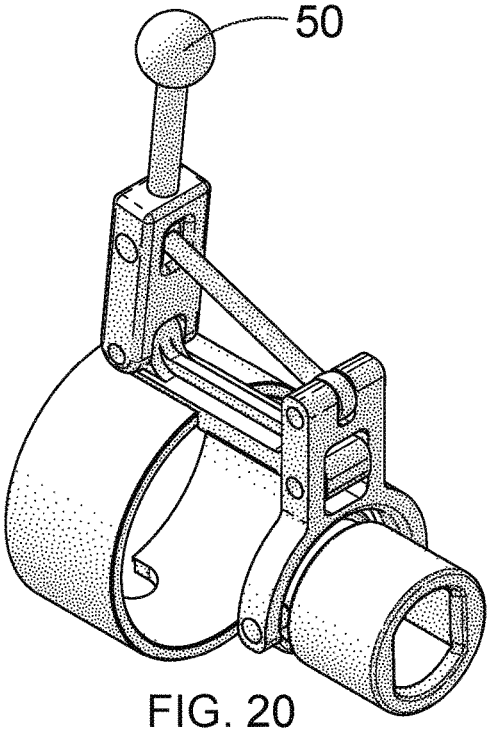
FIG. 20 illustrates an embodiment of an integrated wrench collar according to the present disclosure with an alternate handle.
Figure 21:
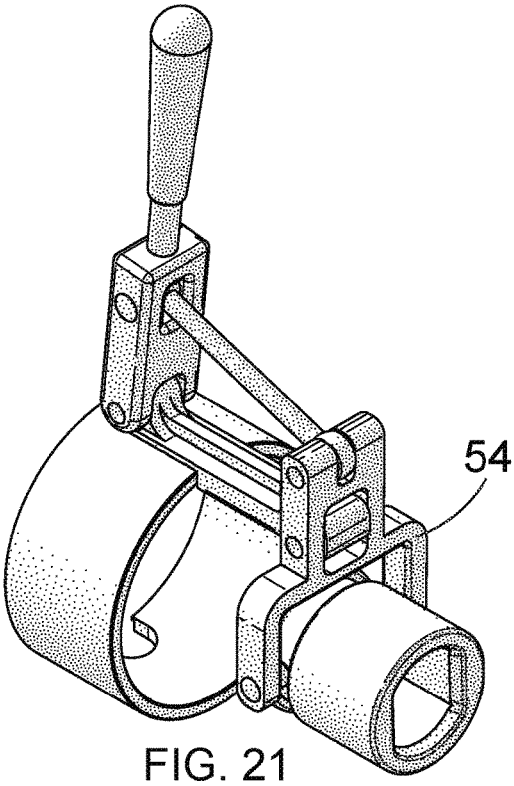
FIG. 21 illustrates an embodiment of an integrated wrench collar according to the present disclosure, with an alternate clamp jaw shape.
Figure 22:
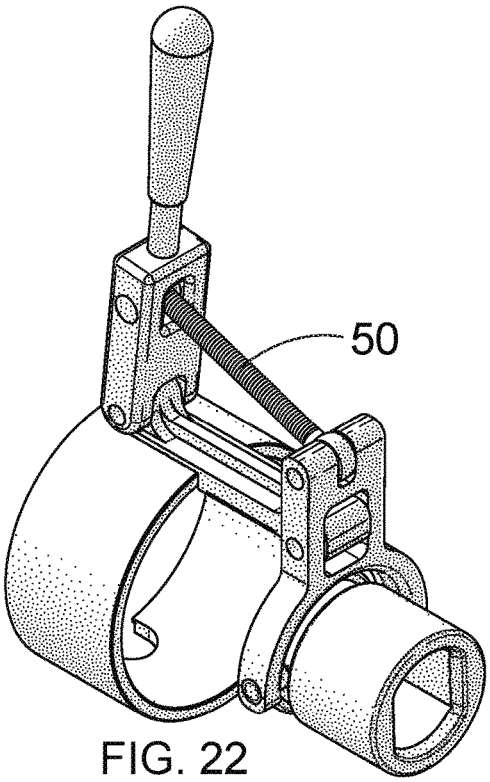
FIG. 22 illustrates an embodiment of an integrated wrench collar according to the present disclosure, with an adjustable screw as the positioning bar.
Figure 23:
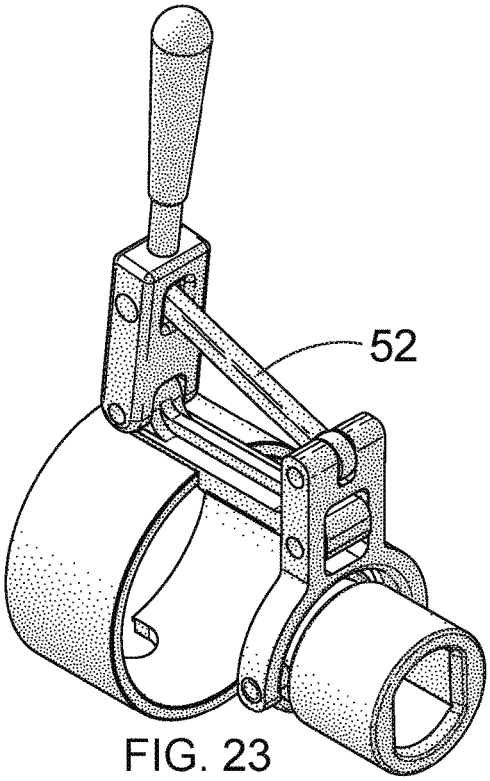
FIG. 23 illustrates an embodiment of an integrated wrench collar according to the present disclosure, with a static positioning bar.

In the drawings, when handle 50 is pulled back, attached connector 65 also is pulled back, causing retraction of positioning arm 63 by means of bar 52. As positioning arm 63 is pulled back by arm 52, pivoting means 61 cause the ends of jaw 54 to be pulled forward and wrench collar 56 now is pushed forward on to the stem/adapter joint by means of pins 55 in groove 57. This position can be called the "engaged" position. When handle 50 is pulled forward, arm 63 is pushed forward via bar 52, and pivot means 61 cause attached jaw 54 to move backwards, pulling collar 56 off the stem/adapter joint by means of pins 55 in groove 57. This position can be considered a "resting" position. FIGS. 20-22 show various different embodiments for integrated wrench collar mechanisms, including embodiments with alternate handles (FIG. 20); alternate jaw shapes (FIG. 21); and alternate positioning bars (a threaded screw, FIG. 22), and a solid bar (FIG. 23).

FIGS. 6-14 illustrate various embodiments of an integrated breakout wrench device and methods and mechanisms for easily and quickly breaking or cracking open pipe section joints created using devices of the present disclosure.

With reference to the figures, a breakout wrench device, mechanism and method of use are disclosed herein. In accordance with one embodiment of the present disclosure, during drilling, when the carriage is in a full forward position, a free drill pipe stem has been threaded onto and added to an existing drill string or drill stem 46 and the drill string has been drilled forward into the ground such that the drill adapter/stem joint now is at or near the front plate and front plate aperture 35. This location is sometimes referred to in the art as the "pit face" and defines the forward-most or second limiting position for the carriage. The adapter/stem joint now needs to be cracked or broken open to release the drive unit from the drill string. Once the wrench is positioned on the joint, the rotational hydraulic drive rotates the drill stem to "break open" the joint and unthread the stem from the drive unit. The drive unit now is released from the drill string, the wrench is removed from its joint position, and the carriage can be moved back to it rear-most position in the chassis (also referred to herein as the first limiting position). At this first position, a new stem pipe is threaded onto the adapter, the carriage is moved forwarded, and the pipe rotated to thread its free end onto the exposed and available stem end of the drilled string. Once threaded onto the existing string, the hydraulic drive unit moves the carriage forward again along the chassis longitudinal axis, drilling the newly added pipe into the earth, until the carriage reaches it second limiting position at the pit face again. The adapter/stem joint then is broken open with assistance of the joint wrench, as before, and the process repeats until the desired drill string length as been created.

Figure 7:
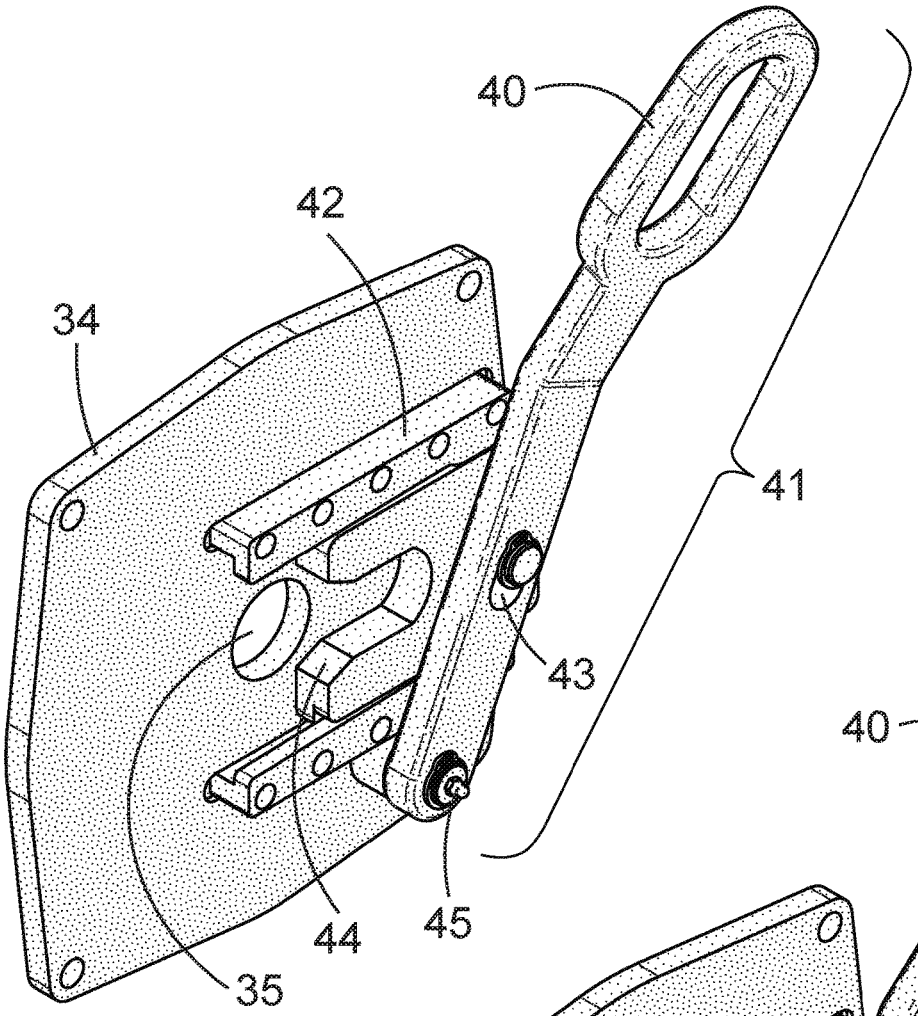
FIG. 7 illustrates in close-up one embodiment of an integrated breakout wrench according to the present disclosure.
Figure 8:
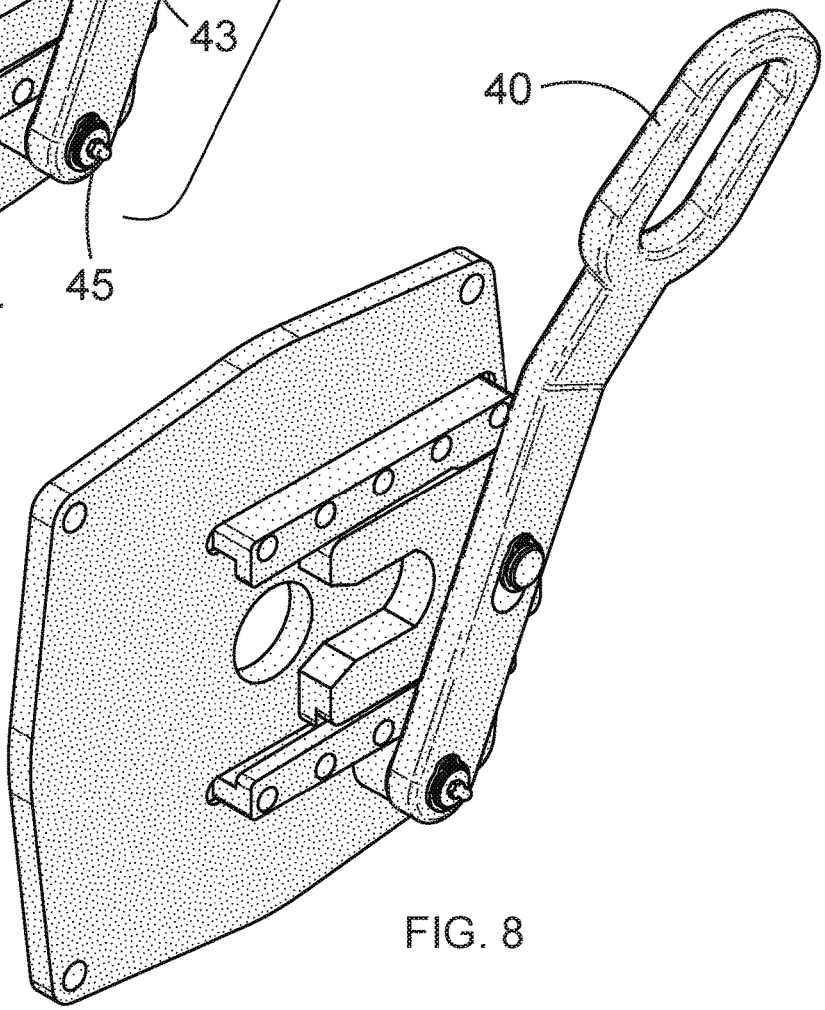
FIG. 8 illustrates another embodiment of an integrated breakout wrench according to the present disclosure, with a bent loop handle.
Figure 9:
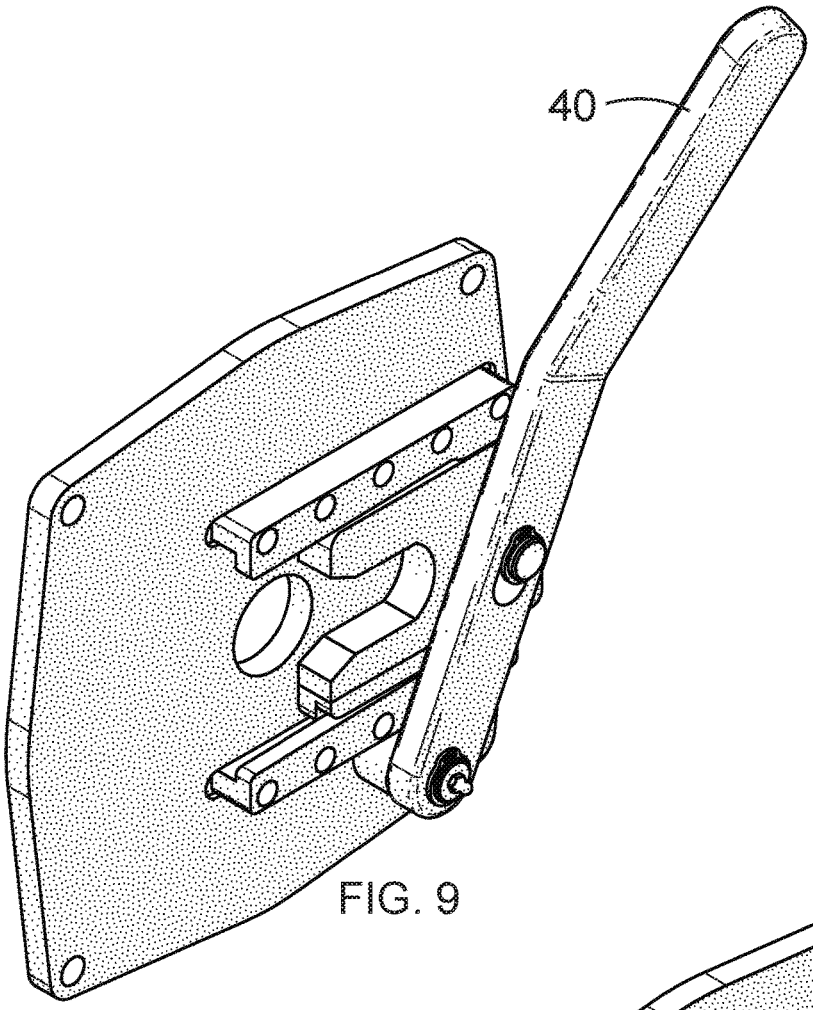
FIG. 9 illustrates still another embodiment of an integrated breakout wrench according to the present disclosure, with a bent grip.
Figure 10:
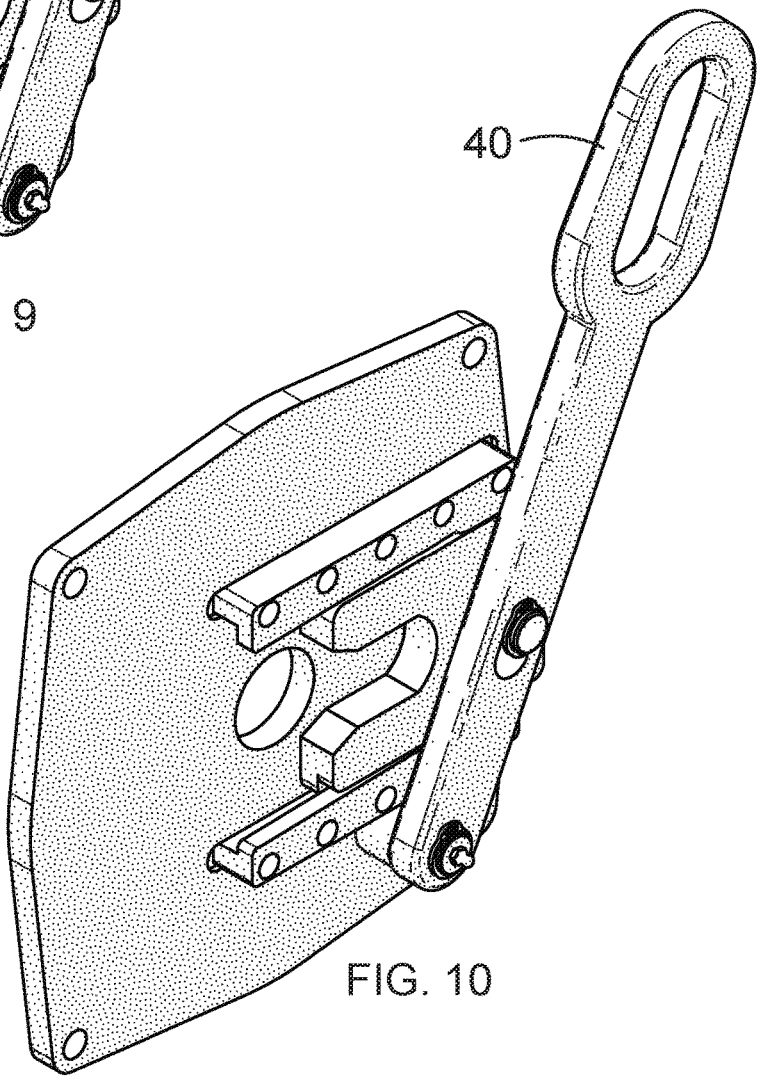
FIG. 10 illustrates yet another embodiment of an integrated breakout wrench according to the present disclosure, with a straight loop handle.
Figure 11:
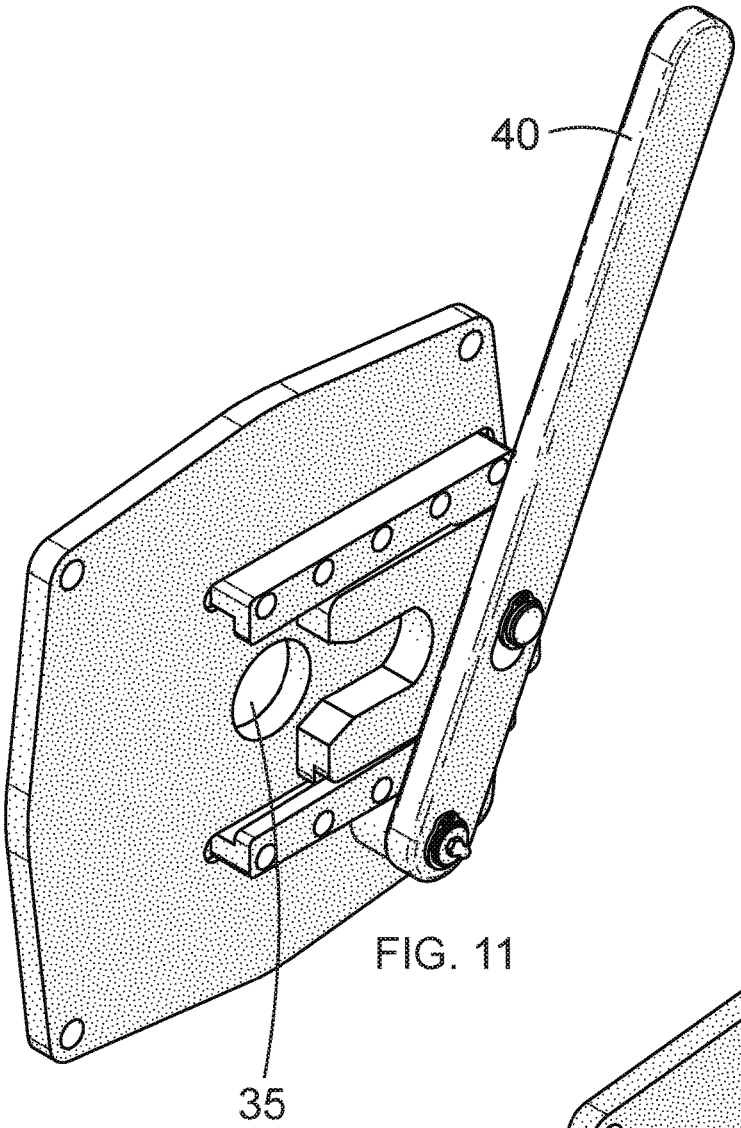
FIG. 11 illustrates still another embodiment of an integrated breakout wrench according to the present disclosure, with a straight grip.
Figure 12:
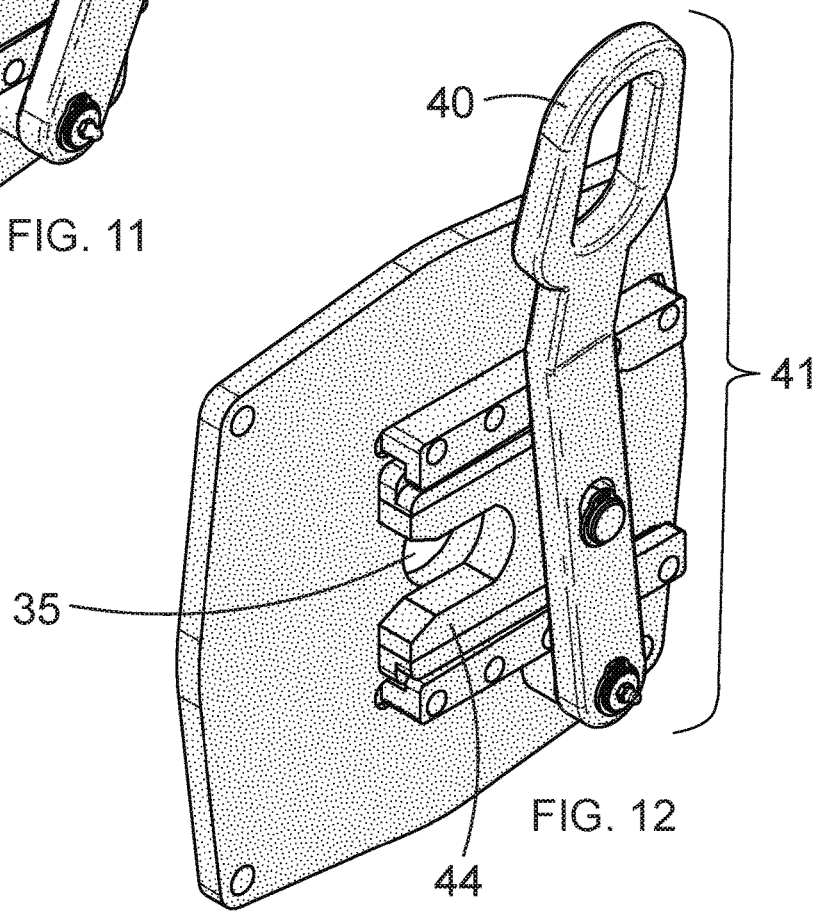
FIG. 12 illustrates the breakout wrench illustrated in FIG. 7, now in the engaged position.
Figure 13:
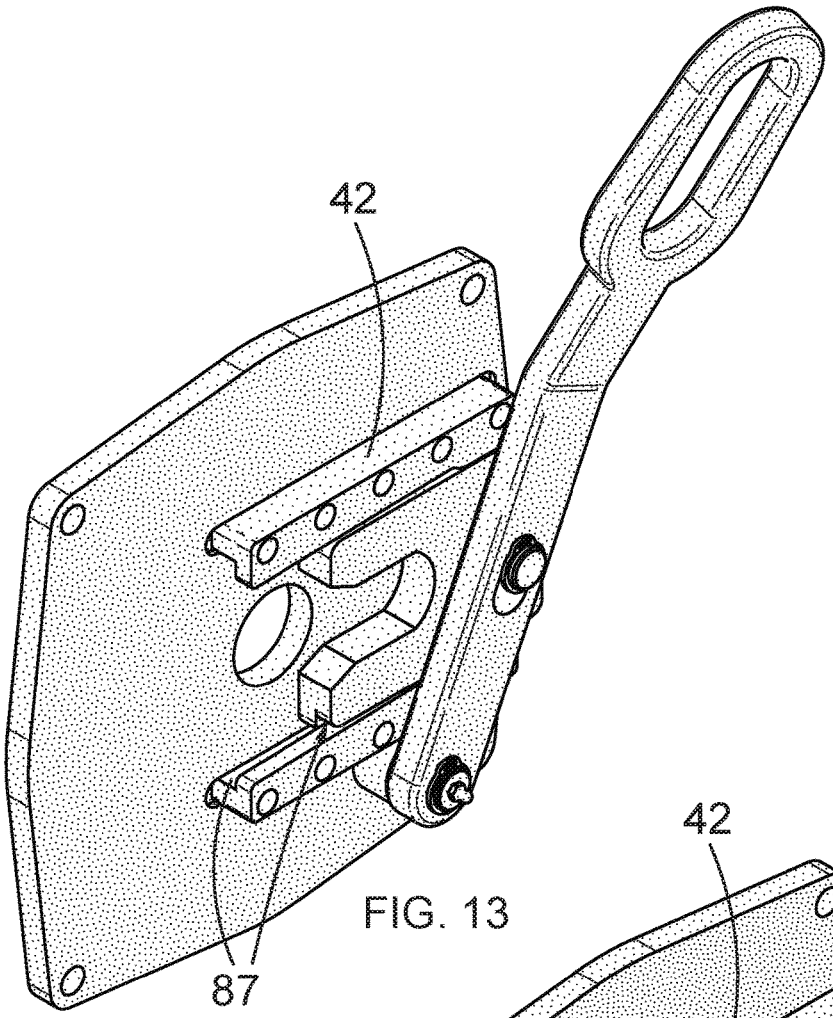
FIG. 13 illustrates another embodiment of an integrated breakout wrench according to the present disclosure, using an interlocking lip slide system to position the wrench.

FIG. 7 illustrates an isolation view of an integrated breakout wrench mechanism 41 useful in this joint cracking or breakout step. In the figure, wrench mechanism 41 comprises a handle 40, a wrench jaw 44 which functions as a horseshoe wrench, and a linear slide means 42 along which jaw 44 can move into position on the joint to be cracked. Preferably jaw 44 has flared or angled or chamfered edges that allow ease of positioning the wrench on the joint. Handle 40 can be used to position jaw 44 on the joint. Slide or glide means 42 also can serve to limit lateral movement of the horseshoe wrench about the joint and thereby limit or otherwise inhibit excess rotation of wrench jaw 44 about the radial axis of the stem joint.

When a drill string is being retrieved, the joint between pipe stem adapter 92 and drill string first can be cracked open as described above. Collar 56 then is engaged, and carriage 18 is moved back to its full re-set position, bringing with it the pipe string so that the next proximal forward pipe joint is available to the drill stem joint wrench breakout system. Wrench 44 then can be used to crack open this joint so that newly exposed pipe stem can be easily unthreaded from the drill string. Collar wrench 56 then is moved off the stem/adapter joint and the hydraulic rotational means used to unthread the stem from the adapter. The free pipe is removed and the carriage then is moved forward to the pit face. The adapter once again is threaded onto the newly exposed stem joint, the collar wrench positioned onto the new stem/adapter joint, and the carriage pulled back again to retrieve the next stem. The process and steps are repeated until the string is completely retrieved and the drill head or reamer, along with any attached pipe or conduit, have been pulled through the pit face and aperture 35 into the chassis interior.

Figure 14:
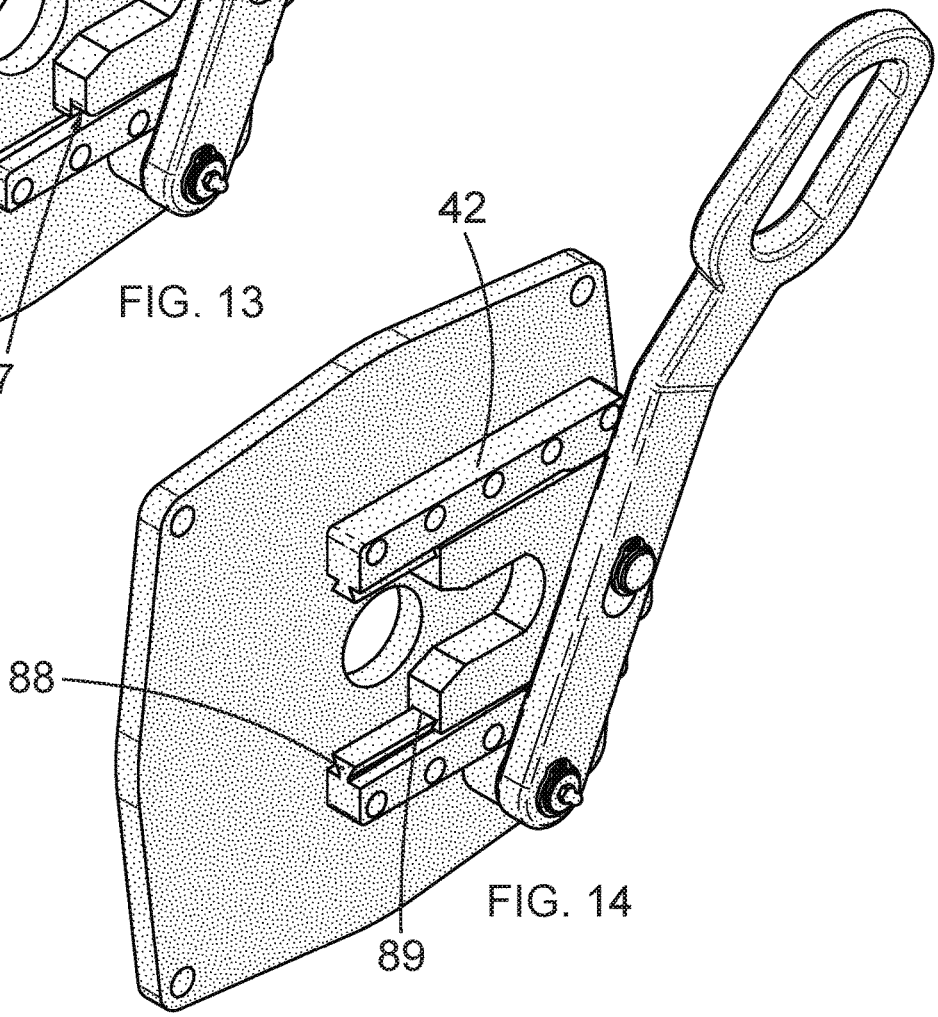
FIG. 14 illustrates another embodiment of an integrated breakout wrench according to the present disclosure, using a tongue and groove system to position the wrench.
Figure 15A:
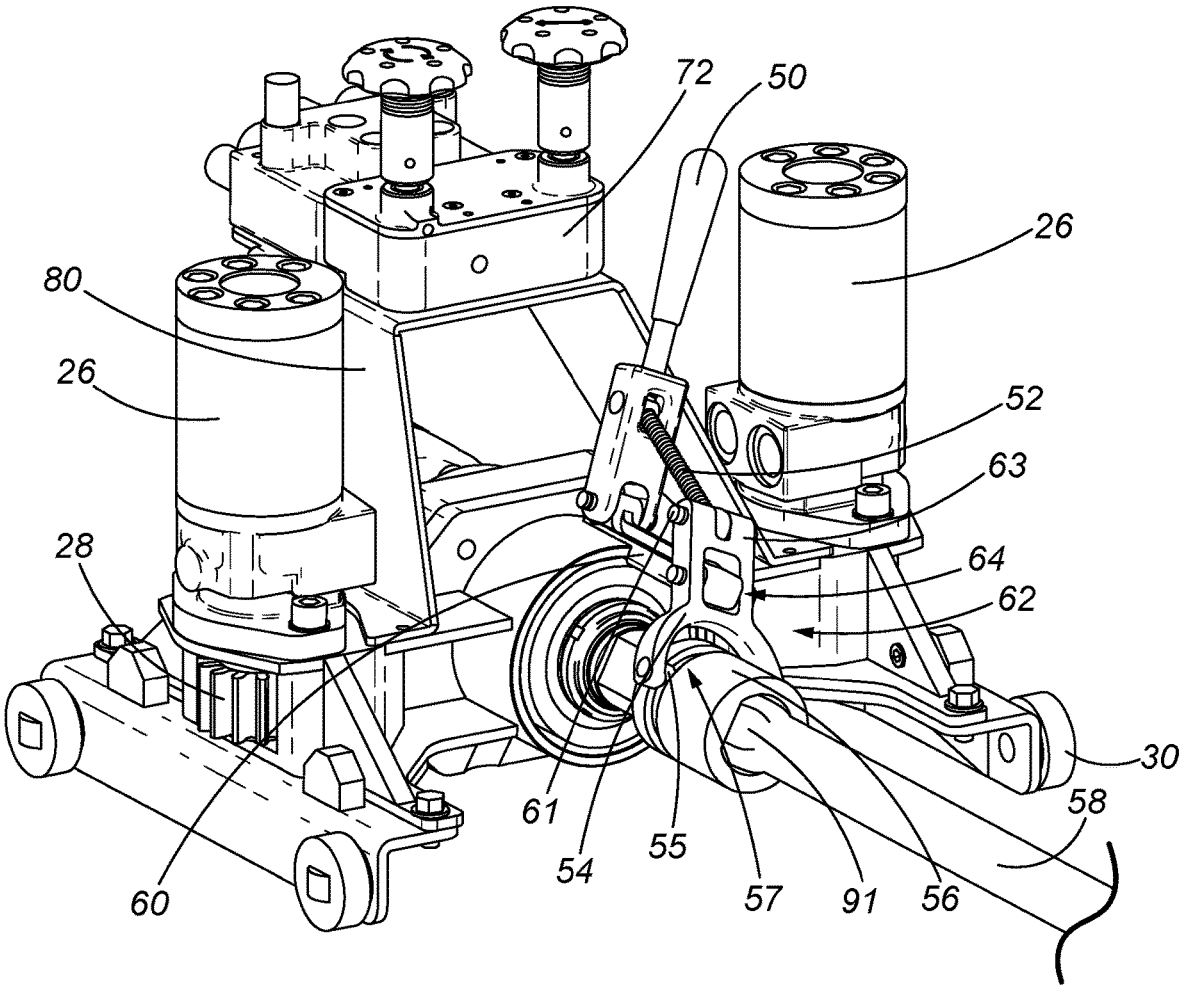
FIGS. 15A and 15B illustrate one embodiment of an integrated wrench collar according to the present disclosure, with the collar in the engaged position (15A) and the resting position (15B)
Figure 15B:
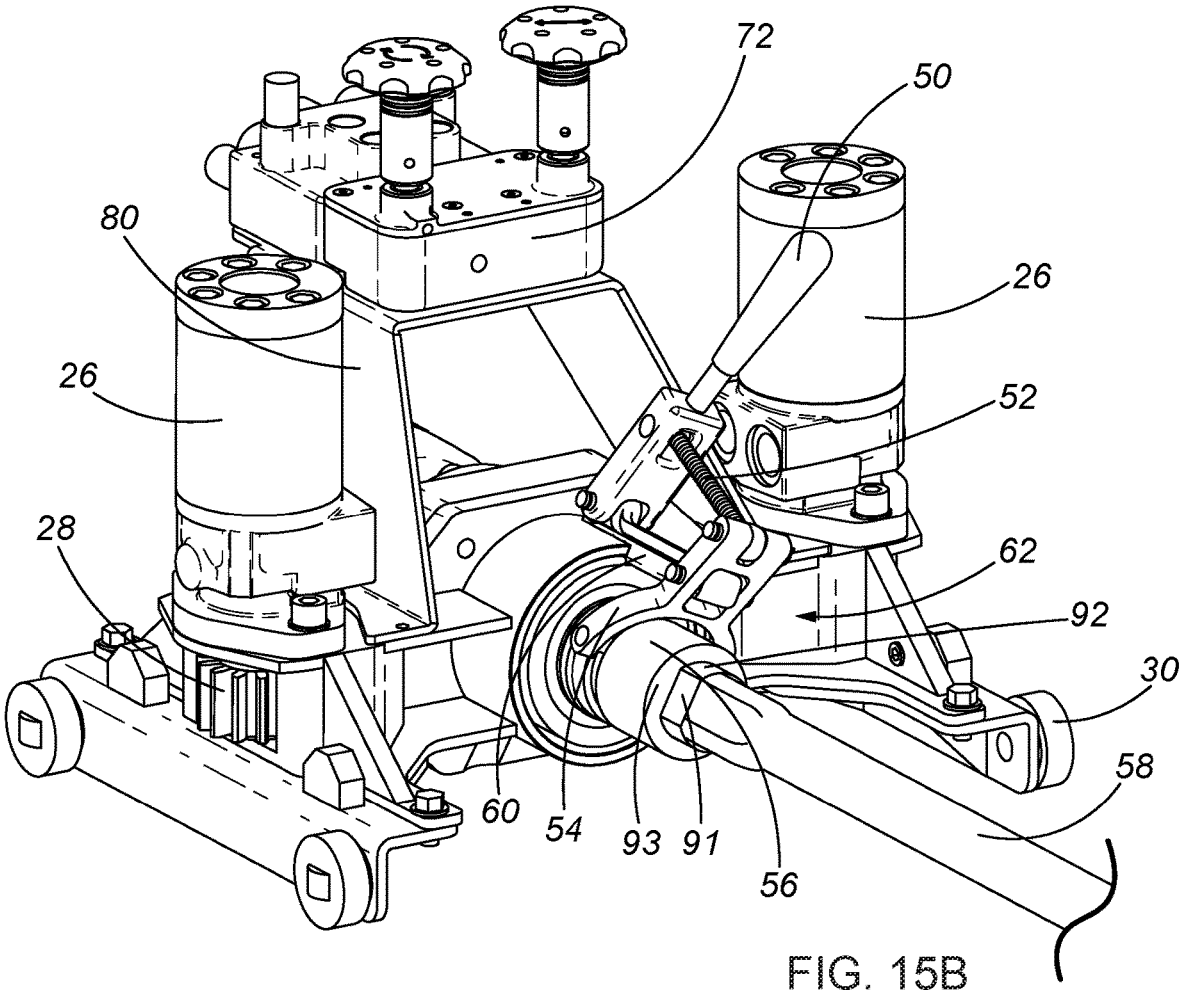

FIGS. 7-14 disclose various embodiments of the breakout wrench system of the disclosure, including: alternative handles, bent and straight (FIGS. 7-12); and alternative slide systems, including interlocked lips or steps 87 (FIG. 13) and tongue 88 and groove 89 systems (FIG. 14).

Embodiments of this disclosure may be embodied in other specific forms without departing from the spirit or essential characteristics thereof. The present embodiments are therefore to be considered in all respects as illustrative and not restrictive, the scope of the disclosure being indicated by the appended claims rather than by the foregoing description, and all changes that come within the meaning and range of equivalency of the claims are therefore intended to be embraced therein. While illustrative embodiments have been illustrated and described, it will be appreciated that various changes can be made therein without departing from the spirit and scope of the disclosure.

The embodiments of the invention in which an exclusive property or privilege is claimed are defined as follows:

1. A pit launch horizontal drilling device comprising:

a) a chassis component comprising a back plate, a front plate configured to allow passage of a drill bore therethrough, and parallel, opposing side panels joining said back plate to said front plate, the inside surface of each said side panel comprising a toothed rack having a continuous straight tooth profile extending along the panel longitudinal axis and, coupled thereto, b) a carriage component comprising a pair of laterally opposed toothed gears dimensioned and positioned to engage said chassis component toothed racks as pinions, hydraulic drive motor means for rotating said toothed gears such that said carriage component can travel forward and back along said chassis toothed racks, hydraulic rotary drive means for releasably coupling to a drill stem end to form a drill stem joint and rotating said coupled drill stem in opposing directions, a wrench collar element coupled to said rotary drive means, in operational association with said drill stem joint, and comprising means for selectively positioning said collar on and off said drill stem joint, said collar configured to limit drill stem uncoupling when positioned on said drill stem joint and said drill stem is rotating in an uncoupling orientation, and hydraulic valving means for directing rotation of said coupled drill stem and traversal of said carriage component along said chassis component toothed racks.

2. The device of claim 1 wherein the interior surface of each said chassis component side panel further comprises a guide rail extending along the panel longitudinal axis, and said carriage component further comprises laterally opposing bearings positioned and dimensioned to engage with said guide rails such that said bearings travel along said rails as said carriage component traverses said chassis toothed racks.

3. The device of claim 2 wherein said bearing comprises a needle bearing.

4. The device of claim 2 wherein said bearing comprises a dual ball bearing having axial and radial load capacity.

5. The device of claim 2 wherein said guide rail comprises a channel.

6. The device of claim 1 wherein said hydraulic drive motor means comprises a pair of laterally opposed motors operationally coupled to said toothed gears.

7. The device of claim 1 wherein said chassis component length between said front plate and said back plate is extensible.

8. The device of claim 1 wherein said chassis component further comprises an attached, positionable wrench element configured to selectively grip said drill stem joint at said chassis component front plate.

9. A pit launch horizontal drilling device comprising a chassis component and a carriage component coupled thereto, the chassis component having a front and back plate and parallel, opposing side walls, each side wall interior comprising a toothed rack having a continuous straight tooth profile and a guide rail extending along the side wall longitudinal axis, the carriage component dimensioned to span the interior distance between said chassis component side walls and comprising hydraulic rotating drive means for releasably coupling to a drill stem end to form a drill stem joint and rotating said coupled drill stem in opposing directions, and a wrench collar element coupled to said rotary drive means, in operational association with said drill stem joint, and comprising means for selectively positioning said collar on and off said drill stem joint, said collar configured to limit drill stem uncoupling when positioned on said drill stem joint and said drill stem is rotating in an uncoupling orientation, pinion gears dimensioned and positioned to engage said toothed racks and hydraulic motor means for rotating said gears about said toothed racks such that said carriage component traverses said chassis component along said racks, and bearings dimensioned and positioned to engage said guide rails such that said bearings travel along said rails as said pinion gears rotate about said toothed racks.

10. The device of claim 9 wherein said bearings comprise needle bearings.

11. The device of claim 9 wherein said bearings comprise dual ball bearings having axial and radial load capacity.

12. The device of claim 9 further comprising an attached, positionable wrench element for selectively gripping said drill stem joint at the chassis component front plate.

13. The device of claim 9 wherein said guide rail is located below said toothed rack on each said chassis component side wall.

14. The device of claim 9 wherein said guide rail comprises a channel.

15. The device of claim 9 further comprising hydraulic valving means for directing rotation of said attached drill stem and rotation of said pinion gears about said toothed racks.

16. A method for drilling a bore hole underground in a substantially horizontal direction from a surface dug hole, the method comprising the steps of:

(a) providing a pit launch horizontal drilling device to said surface dug hole, said device having a stationary frame and a carriage component engaged therewith and competent to move forward and back along said frame between two limiting positions, said carriage component being provided in the first limiting position;

said stationary frame comprising a back plate, a front plate comprising an aperture configured to allow passage of a drill bore therethrough and a positionable wrench element configured to selectively grip a drill stem and limit rotation of said drill stem about a drill stem joint, and parallel, opposing side panels joining said back plate to said front plate, the inside surface of each said side panel comprising a toothed rack having a continuous straight tooth profile, extending along the panel longitudinal axis;

said carriage component dimensioned to span the interior distance between said chassis component side panels and comprising pinion gears dimensioned and positioned to engage said toothed racks and hydraulic motor means for rotating said gears about said toothed racks such that said carriage component traverses said chassis component along said racks between said two limiting positions;

hydraulic rotating drive means for releasably coupling to a drill stem end to form a first drill stem joint and rotating said coupled drill stem in opposing directions, a wrench collar element coupled to said rotary drive means, in operational association with said first drill stem joint, and comprising means for selectively positioning said collar on and off said drill stem joint, said collar configured to limit drill stem uncoupling when positioned on said drill stem joint and said drill stem is rotating in an uncoupling orientation;

(b) providing hydraulic power to said hydraulic rotating drive means to engage a drill stem end and form a first drill stem joint;

(c) providing hydraulic power to said hydraulic motor means to move said carriage component forward along said chassis until said first drill stem joint is at said aperture in said front plate and said carriage is at said second limiting position;

(d) positioning said wrench element on said drill stem at said aperture and reversing direction of said drill stem rotation to disengage said drill stem from said rotating drive means thereby leaving a free drill stem end at said aperture;

(e) moving said carriage component back along said frame to said first limiting position;

(f) providing one end of a new drill stem having two ends to said free drill stem end at said aperture and the second end to said hydraulic rotating drive means;

(g) providing hydraulic power to said hydraulic rotating drive means and said hydraulic motor means, moving said carriage component forward while engaging said new drill stem, thereby forming a new first drill stem joint at said hydraulic rotating drive means, and a second drill stem joint at said aperture;

(h) positioning said wrench element off said drill stem at said aperture and moving said carriage component forward along said chassis until said first drill stem joint is at said aperture in said front plate, said second drill stem joint is in the bore hole, and said carriage is at said second limiting position;

(i) positioning said wrench element on said new drill stem and reversing direction of said rotating drive means rotation to disengage said new drill stem from said rotating drive means thereby leaving a free drill stem end at said aperture;

a) moving said carriage component back along said frame to said first limiting position, and (k) repeating steps (f)-(j) until said bore hole is complete.

17. The method of claim 16 further comprising the steps of retrieving said drill stems from said bore hole by (l) providing said carriage component at said second limiting position, said hydraulic rotating drive means coupled to a first drill stem end at said aperture via a first said drill stem joint;

(m) providing hydraulic power to said hydraulic motor means to move said carriage component back along said chassis until a said second drill stem joint and associated second drill stem is retrieved from said bore hole and at said aperture;

(n) positioning said wrench element on said second drill stem joint at said aperture and said wrench collar on said first drill stem joint at said hydraulic rotating drive means and rotating said drill stem in an uncoupling rotation to disengage said first second drill stem;

(o) retracting said wrench collar from said first drill stem joint and continuing uncoupling rotation to disengage said drill stem from said rotating drive means, and (p) repeating steps (l)-(o) until all drill stems are retrieved from said bore hole.

18. The method of claim 16 wherein the interior surface of each said chassis side panel further comprises a guide rail extending along the panel longitudinal axis, and said carriage component further comprises laterally opposing bearings positioned and dimensioned to engage with said guide rails such that said bearings travel along said rails as said carriage component traverses said chassis toothed racks.

19. The method of claim 18 wherein said bearing comprises a needle bearing.

20. The method of claim 18 wherein said bearing comprises a dual ball bearing having axial and radial load capacity.

21. The method of claim 18 wherein said guide rail comprises a channel.

* * * * *